US005379055A

United States Patent [19]

Yoshida et al.

[11] Patent Number: 5,379,055

[45] Date of Patent: Jan. 3, 1995

[54] THERMAL TRANSFER RECORDING APPARATUS AND FACSIMILE TERMINAL EQUIPMENT USING SAID APPARATUS

[75] Inventors: Takehiro Yoshida; Makoto Kobayashi, both of Tokyo; Minoru Yokoyama, Yokohama; Takeshi Ono, Kawasaki; Takashi Awai; Yasushi Ishida, both of Tokyo; Akihiro Tomoda; Tomoyuki Takeda, both of Yokohama; Masaya Kondo, Tokyo; Masakatsu Yamada, Yokohama, all of Japan

[73] Assignee: Canon Kabushiki Kaisha, Tokyo, Japan

[21] Appl. No.: 813,095

[22] Filed: Dec. 24, 1991

[30] Foreign Application Priority Data

Dec. 25, 1990 [JP] Japan ..... 2-405893
Apr. 22, 1991 [JP] Japan ..... 3-090582

[51] Int. Cl.[6] ..... B41J 17/08; B41J 17/10

[52] U.S. Cl. ..... 346/76 PH; 400/232; 400/236; 400/236.2

[58] Field of Search ..... 400/224.1, 224.2, 225, 400/232, 236, 236.2, 120; 346/76 PH

[56] References Cited

U.S. PATENT DOCUMENTS

| | | | |
|---|---|---|---|
| 3,984,809 | 10/1976 | Dertouzous et al. | 346/76 R |
| 4,265,410 | 5/1981 | Fanning | 242/56.1 |
| 4,496,117 | 1/1985 | Kashiwagi et al. | 242/191 |
| 4,712,113 | 12/1987 | Brooks et al. | 346/1.1 |
| 4,788,558 | 11/1988 | Caldwell et al. | 346/76 PH |

FOREIGN PATENT DOCUMENTS

| | | |
|---|---|---|
| 57-83471 | 5/1982 | Japan . |
| 58-7377 | 1/1983 | Japan . |
| 58-201686 | 11/1983 | Japan . |
| 60-240480 | 11/1985 | Japan . |
| 63-98480 | 4/1988 | Japan . |
| 0121866 | 5/1990 | Japan . |

*Primary Examiner*—Benjamin R. Fuller
*Assistant Examiner*—Huan Tran
*Attorney, Agent, or Firm*—Fitzpatrick, Cella, Harper & Scinto

[57] ABSTRACT

There is disclosed a thermal transfer recording apparatus for recording an image by transferring the ink contained in an ink sheet onto a recording medium, wherein the apparatus comprises ink sheet conveying means for conveying said ink sheet, recording medium conveying means for conveying said recording medium, recording means for recording onto said recording medium by acting on said ink sheet, and control means for controlling the driving amount of said ink sheet conveying means when the power is turned on.

10 Claims, 22 Drawing Sheets

| |
|---|
| FIG. 7A |
| FIG. 7B |

| |
|---|
| FIG. 10A |
| FIG. 10B |

THERMAL TRANSFER RECORDING APPARATUS AND FACSIMILE TERMINAL EQUIPMENT USING SAID APPARATUS

BACKGROUND OF THE INVENTION

1. Field of the Invention

The present invent ion relates to a thermal transfer recording method and apparatus for recording an image onto a recording medium by transferring the ink contained in an ink sheet to the recording medium, and a facsimile terminal equipment using said apparatus, and more particularly to a thermal transfer recording apparatus wherein the length of ink sheet to be used for the recording is L/n (n>1) for a predetermined recording length L of the recording medium.

2. Related Background Art

Generally, a thermal transfer printer uses an ink sheet with the heat-fusible (or heat-sublimable) ink applied to the base film to heat selectively the ink sheet with the thermal head in accordance with an image signal, and record an image by transferring the fused (or sublimated ) ink onto a recording sheet. As this ink sheet in general allows the ink to be transferred entirely onto the recording sheet with one time of recording (a so-called one-time sheet ), it is needed to convey the ink sheet by an amount corresponding to the recorded length and then to bring unused part of the ink sheet to the next recording position with accuracy, after one character or line has been recorded. Therefore, the usage of the ink sheet is increased, the running cost for the thermal transfer printer tends to be greatly higher than for the ordinary thermal sensitizing recording apparatus which records onto a thermosensible sheet.

To solve the above problem, a thermal transfer printer has been proposed in which a recording sheet and an ink sheet are conveyed with a difference of speed, as described in U.S. Pat. No. 3984809, Japanese Laid-Open Patent Application No. 57-83471 or No. 58-201686, or Japanese Patent Publication No. 62-58917.

The present invention has further developed those described in the publications as above mentioned.

As the ink sheet for use in the thermal transfer printer, an ink sheet allowing for the multiple times (n) of image recording (so called a multi-print sheet) is known, with which it is possible to record a recording length L continuously, while the length of conveying the ink sheet after or during image recording is less than the length L (L/n : n>1) . Thereby, the use efficiency of the ink sheet can be increased to n times that for a conventional one, which will lead to a reduced running cost in the thermal transfer printer. Thereinafter, such a recording method is called as the multi-print.

When the multi-print is used with such an ink sheet, it is necessary that the ink sheet is conveyed a fixed distance for a predetermined length of recording.

In such a thermal transfer printer, the ink sheet having a width substantially corresponding to one page of recording sheet is conveyed by winding it. This can be performed by rotating a rotation shaft of a take-up roller for the ink sheet. With such a constitution, a take-up mechanism of the ink sheet is simple, and the ink sheet can be pulled with substantially the same force across the width direction, so that there is the advantage that the recording can be fairly made without yielding any wrinkles on the ink sheet.

In such a conveyance control, if the conveyance amount of the ink sheet is controlled with the rotation of a support shaft of the take-up roll for the ink sheet, the diameter of the take-up roll for taking up the ink sheet is larger with increasing usage of the ink sheet, so that even if the take-up roll is controlled for the same amount of rotation, the conveyance distance of the ink sheet may be different depending on the take-up position. Therefore, the ink sheet may be conveyed by means of a capstan roller and a pinch roller for carrying the ink sheet therebetween.

However, in order to take up the ink sheet, it is necessary to pull the ink sheet with a great force in a take-up direction, so that those rollers may be disordered in a long service time, and can not convey the ink sheet evenly. Further, there is a problem that the mechanical unit becomes complex with the rollers, thereby increasing the cost.

Also, a thermal transfer printer has been proposed in which the conveyance length of the ink sheet is made substantially constant relative to that of the recording sheet in such a way as to detect the rotation amount of an ink sheet supply roller relative to a predetermined driving amount (number of driving steps) for an ink sheet conveying motor, and adjust the rotation amount of an ink sheet conveying motor in accordance with that detected value. However, such thermal transfer printer is constituted in such a way that when the ink sheet is exchanged due to the exhaustion of ink sheet, the adjustment for the rotation amount of the ink sheet conveying motor made with reference to a recorded result of the first page, so that the conveyance length of the ink sheet can not be made constant relative to that of the recording sheet unless the first page has been recorded. Thus, there is a problem that the image quality of recording can not be assured in recording the first page after the ink sheet cartridge is exchanged. Also, there is a problem that if the ink sheet cartridge is exchanged at the power off, the driving of the ink sheet conveying motor after the power on will be made with the rotation amount determined based on the ink sheet cartridge prior to the exchange, which is unsuitable for the ink sheet cartridge after the exchange, so that the conveyance length of the ink sheet can not be made constant.

SUMMARY OF THE INVENTION

In the light of the above-mentioned conventional example, it is an object of the present invention to provide a thermal transfer recording apparatus in which the conveyance length of ink sheet is made substantially constant for the conveyance length of recording sheet even immediately after the exchange of an ink sheet cartridge or when the ink sheet cartridge is exchanged in the power off state.

It is another object of the present invention to provide a thermal transfer recording apparatus for recording an image by transferring the ink contained in an ink sheet onto a recording medium, comprising:

- ink sheet conveying means for conveying the ink sheet,
- recording medium conveying means for conveying the recording medium,
- recording means for recording onto the recording medium by acting on the ink sheet, and
- control means for controlling the driving amount of the ink sheet conveying means when the power is detected to be turned On.

It is another object of the present invention to provide a thermal transfer recording apparatus for recording an image by transferring the ink contained in an ink sheet onto a recording medium, comprising:

ink sheet conveying means for conveying the ink sheet, recording medium conveying means for conveying the recording medium, recording means for recording onto the recording medium by acting on the ink sheet, and control means for controlling the driving amount of the ink sheet conveying means every time the recording operation for the recording medium with the recording medium is completed for one sheet.

It is another object of the present invention to provide a thermal transfer recording apparatus for recording an image by transferring the ink contained in an ink sheet onto a recording medium, comprising:

ink sheet conveying means for conveying the ink sheet, recording medium conveying means for conveying the recording medium, recording means for recording onto the recording medium by acting on the ink sheet, slackness removing means for removing the slackness of the ink sheet, and control means for controlling the driving amount of the ink sheet conveying means after the slackness of the ink sheet is removed with the slackness removing means.

It is another object of the present invention to provide a thermal transfer recording apparatus for recording an image by transferring the ink contained in an ink sheet onto a recording medium, comprising:

ink sheet conveying means for conveying the ink sheet , recording medium conveying means for conveying the recording medium, recording means for recording onto the recording medium by acting on the ink sheet, ink sheet detecting means for detecting the presence or absence of the ink sheet, and control means for controlling the driving amount of the ink sheet conveying means when the ink sheet detecting means detects the presence of the ink sheet.

It is another object of the present invention to provide a facsimile apparatus for recording an image by transferring the ink contained in an ink sheet onto a recording medium, comprising:

ink sheet conveying means for conveying the ink sheet, recording medium conveying means for conveying the recording medium.

recording means for recording onto the recording medium by acting on the ink sheet, cartridge detecting means for detecting the exchange of the ink sheet cartridge, and control means for controlling the driving amount of the ink sheet conveying means when the cartridge detecting means detects the exchange of the ink sheet cartridge.

DETAILED DESCRIPTION OF THE PREFERRED EMBODIMENTS

In the following, a preferred example of this invention will be described in more detail with reference to the accompanying drawings. <Explanation of Facsimile Terminal Equipment (FIGS. 1 to 4)>

Figure 1:
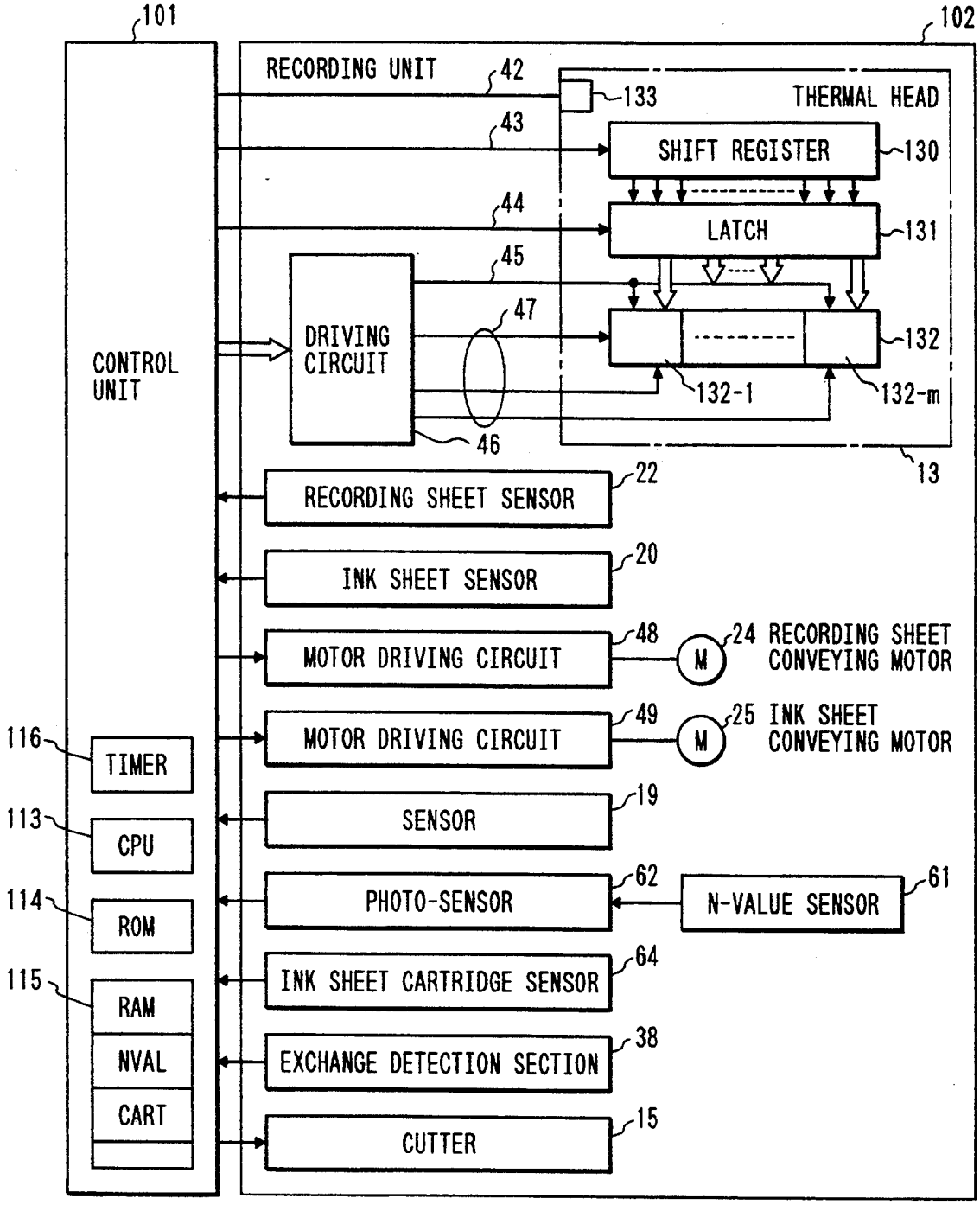
FIG. 1 is a block diagram showing the electrical connections between a control unit and a recording unit in a thermal transfer recording apparatus of an example.
Figure 2:
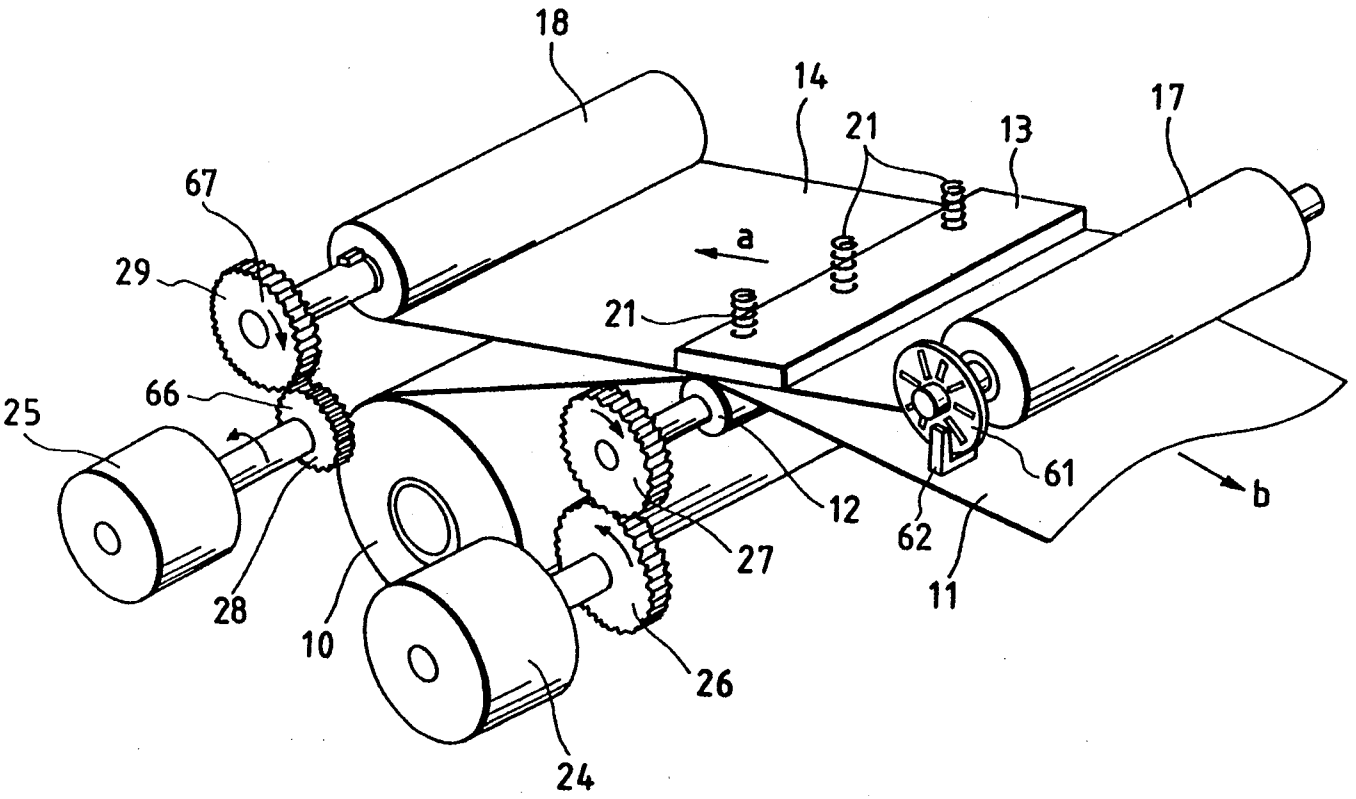
FIG. 2 is a view showing a conveying mechanism for the recording sheet and the ink sheet in the example.
Figure 3:
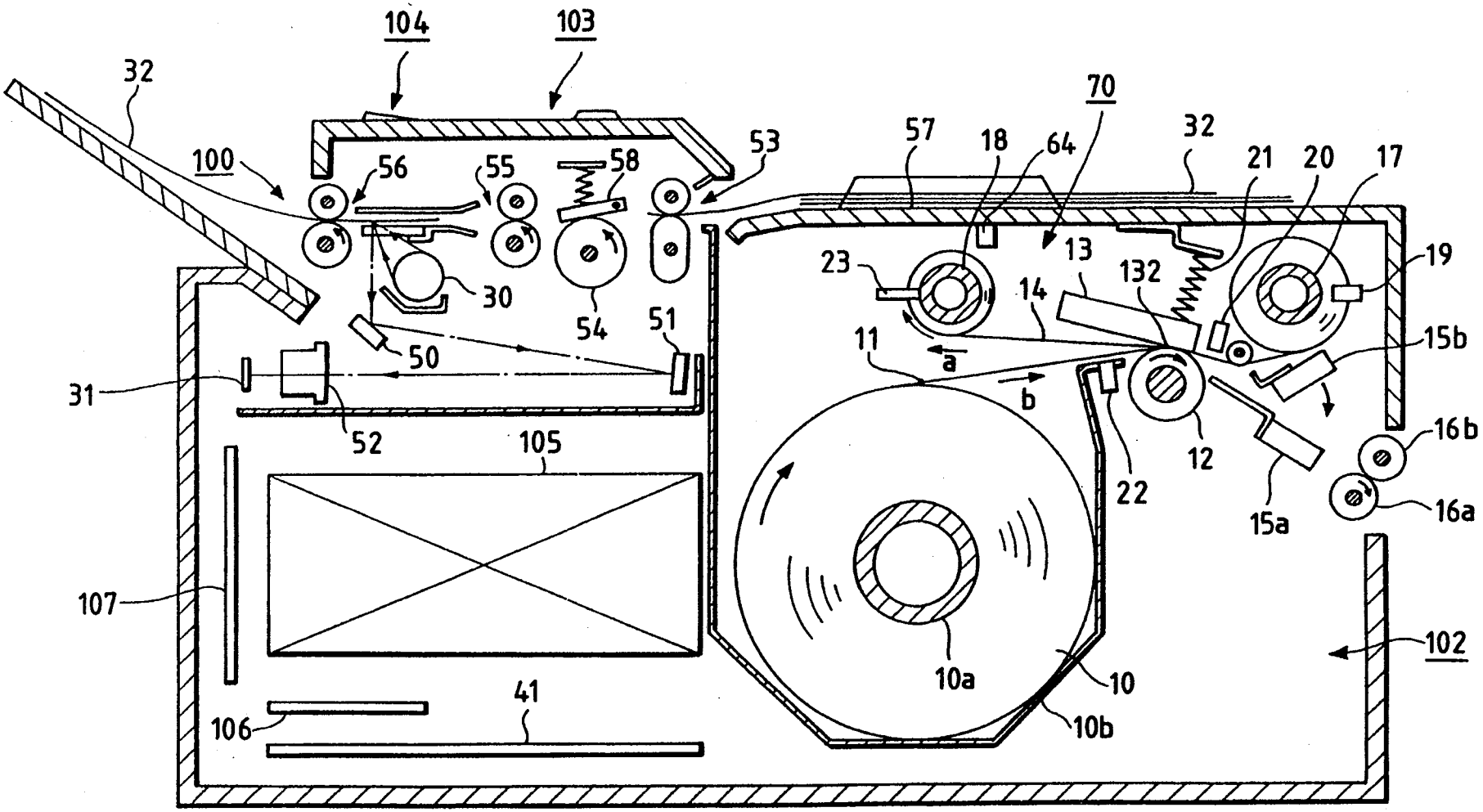
FIG. 3 is a side cross-sectional view showing a mechanical unit of a facsimile terminal equipment in the example.
Figure 4:
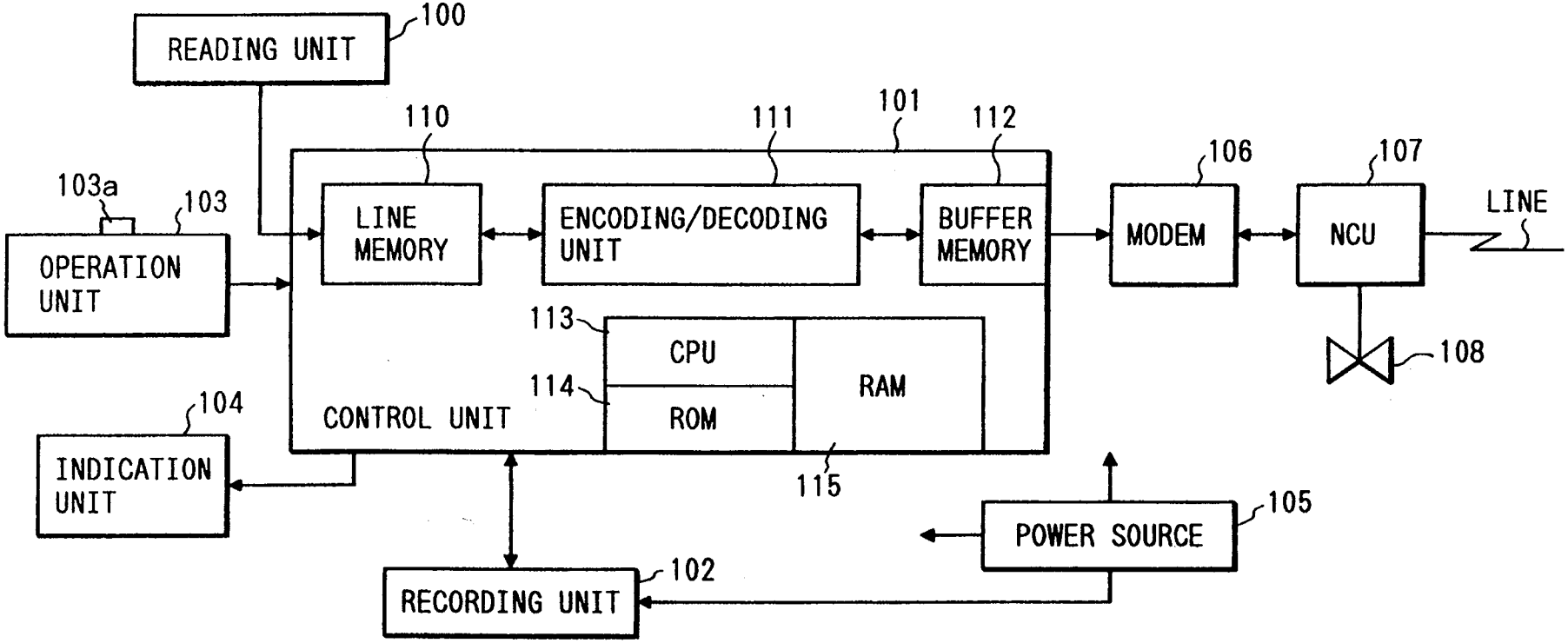
FIG. 4 is a block diagram showing a schematic configuration of the facsimile terminal equipment in the example.

FIGS. 1 to 4 are views showing an instance where a thermal transfer printer using one example of the present invention is applied to a facsimile terminal equipment, in which FIG. 1 is a diagram showing the electrical connections between a control unit 101 and a recording unit 102 in the facsimile terminal equipment, FIG. 2 is a view showing a conveying mechanism for the recording sheet and the ink sheet, FIG. 3 is a side cross-sectional view of the facsimile terminal equipment, and FIG. 4 is a block diagram showing a schematic configuration of the facsimile terminal equipment.

Referring now to FIG. 4, a schematic constitution of the facsimile terminal equipment in the example will be described.

In FIG. 4, 100 is a reading unit for reading an original sheet photoelectrically and outputting it to a control unit 101 as a digital image signal, and is provided with a motor for conveying the original sheet and a CCD image sensor. Now the configuration of the control unit 101 will be described. 110 is a line memory for storing each line of image data, in which one line of image data from the reading unit 100 is stored for the transmission or copy of the original sheet, or one line of received and decoded image data is stored for the reception of image data. An image can be formed by the stored image data which is output to a recording unit 102. 111 is an encoding/decoding unit for encoding image data to be transmitted with an encoding method such as an MH encoding, as well as decoding received encoded image data into image data. 112 is a buffer memory for storing encoded image data that will be transmitted or were received. Each of these portions in the control unit 101 is controlled by the CPU 113 such as a microprocessor. In addition to the CPU 113, the control unit 101 is provided with a ROM 114 for storing control programs for the CPU 113 or various data, and a RAM 115 for temporarily storing various flags or data as a work area for the CPU 113.

102 is a recording unit with a thermal line head for recording an image onto a recording sheet with a thermal transfer recording method. This constitution will be described later in more detail with reference to FIG. 3. 103 is an operation unit which contains various keys for indicating functions such as the start of transmission, or the input keys for telephone number. 103*a* is a switch for indicating the type of ink sheet 14 to be used, i.e., indicating that a multi-print ink sheet is loaded if the switch 103*a* is on, and an ordinary ink sheet 14 is loaded if it is off. 104 is an indication unit, normally provided adjacent to the operation unit 103, for indicating various functions and statuses of the apparatus. 105 is a power source unit for supplying the electric power to the entire apparatus. And 106 is a modem (modulator/-demodulator), 107 is a network control unit (NCU) for performing the automatic terminating operation with the detection of ring back tone or the line control operation, and 108 is a telephone.

Now referring to FIGS. 2 and 3, the constitution of the recording unit 102 will be described below in more detail. Note that the common parts are indicated with the same numerals throughout the drawings.

In FIG. 3, 10 is a roll paper in which a recording sheet 11 which is a plain paper is wound like a roll around a core 10*a*. The roll paper 10 is accommodated within the apparatus to be able to be freely rotated so that the recording sheet 11 may be supplied to a thermal head unit 13 with the rotation of a platen roller 12 in the arrow direction. Note that 10*b* is a roll paper loading section for detachably loading the roll paper 10. Further, 12 is a platen roller for conveying the recording sheet 11 in the direction as indicated by arrow b, as well as serving to press an ink sheet 14 and the recording sheet 11 against the heating resistive elements 132 of thermal head 13. The recording sheet 11 having the image recorded by heating of the thermal head 13 is conveyed in the direction toward an exhausting roller 16 (16*a*, 16*b*) with a further rotation of the platen roller 12, and cut off for each page by a cutter 15 (15*a*, 15*b*) to be mated upon the termination of image recording for one page.

17 is an ink sheet supply roll having the ink sheet 14 wound, and 18 is an ink sheet take-up roll to be driven by an ink sheet conveying motor 25 as will be described later to wind the ink sheet 14 in the direction of arrow a. Note that the ink sheet supply roll 17 and the ink sheet take-up roll 18 are detachably loaded into an ink sheet loading section 70 within a main body of the apparatus. 19 is a sensor for detecting the residual amount of ink sheet 14, or the conveying speed of ink sheet 14. 20 is an ink sheet sensor for detecting the presence or absence of ink sheet 14, and 21 is a spring for pressing the thermal head 13 via the recording sheet 11 and the ink sheet 14 against the platen roller 12. 22 is a recording sheet sensor for detecting the presence or absence of recording sheet. The ink sheet sensor 20 is constituted of a light-reflective photosensor, for example, and used to indicate that one page is only left for the print by detecting a white band of the ink sheet provided near an end portion of the ink sheet. 64 is an ink sheet cartridge sensor for detecting the presence or absence of ink sheet cartridge, or the exchange of ink sheet cartridge, and constituted of a micro switch.

Next, the constitution of the reading unit 100 will be described.

In FIG. 3, 30 is a light source for illuminating an original sheet 32, in which the light reflected from the original sheet 32 is passed through an optical system (mirrors 50, 51, lens 202 ) into a CCD sensor 31, and converted into an electrical signal. The original sheet 32 is conveyed in correspondence to a reading speed of the original sheet 32, by conveying rollers 53, 54, 55, 56 which are driven by an original conveying motor, not shown. Note that 57 is an original stack board, in which a plurality of original sheets stacked on the stack board 57 are separated into one sheet with the cooperation of a conveying roller 54 and a pressing/separating piece 58, and conveyed into the reading unit 100.

41 is a control substrate constituting a main portion of the control unit 101, from which various control signals are output to each unit of the apparatus. 105 is a power source unit for supplying the power to each unit, 106 is a modem substrate unit, and 107 is an NCU substrate unit having a relay function with the telephone line.

FIG. 2 is a view showing the detail of a conveyance mechanism for the ink sheet 14 and the recording sheet 11.

In FIG. 2, 24 is a recording sheet conveying motor for rotating the platen roller 12 to convey the recording sheet 11 in the direction of arrow b opposite to the direction of arrow a (the direction of conveying the ink sheet 14). Here, the recording sheet conveying motor has a least step angle of 7.5 degrees, in which the reduction ratio of the transmission system from a motor rotation shaft of the recording sheet conveying motor 24 to a rotation shaft of the platen roller 12 is "10.0840". Note that the diameter of the platen roller 12 is 20 mm. If the recording sheet 11 is conveyed by rotating the recording sheet conveying motor 24 by half step, the recording sheet 11 is conveyed by one line of the super fine mode with the flotation of the platen roller 12. Note that d is a diameter of tile platen roller 12.

$$2\pi x(d/2)\times(7.5/360)\times(\tfrac{1}{2})\times(1/10.0840)=2\pi x(20/2)\times(7.5/360)\times(\tfrac{1}{2})\times(1/10.0840)=0.0649046(\text{mm})=1/15.402717(\text{mm})$$

25 is an ink sheet conveying motor for conveying the ink sheet 14 in the direction of arrow a. Further, 26, 27 are transmission gears for transmitting the rotation of the recording sheet conveying motor 24 to the platen roller 12, and 28, 29 are transmission gears for transmitting the rotation of the ink sheet conveying motor 25 to the take-up roll 18. Here, the ink sheet conveying motor 25 has a least step angle of 1.8 degrees, in which the reduction ratio of the transmission system from a motor rotation shaft of the ink sheet conveying motor 25 to a rotation shaft of the ink sheet take-up roll 18 is "44.13". Note that the diameter of the ink sheet take-up roll varies from 22 mm to 44 mm.

When recording one line in the super fine mode, the ink sheet 14 is conveyed by two or three half steps in accordance with the diameter of the ink sheet take-up roll 18. For an increasing take-up amount (diameter of the take-up roll 18) for the ink sheet 14, it is possible to adjust the amount of taking up the ink sheet, with two stages, so that the ratio of the conveying amount of the ink sheet 14 to that of the recording sheet 11 may be retained substantially constant. When recording one line in the super fine mode, the moving amount of the ink sheet is $$2\pi x(d/2)\times(1.8/360)\times(\tfrac{1}{2})\times(1/44.13)xn$$

Where d is a take-up diameter of the ink sheet 14, which varies from 22 mm to 44 mm, and n is the number of half steps, which is "2" or "3" in this example.

The rotation of the ink sheet supply roll 17 is detected by providing an encoder plate 61 (thereinafter referred to as an N-value sensor) on a rotation shaft of the ink sheet supply roll 17, as shown in FIG. 2, and detecting the rotation of the shaft by means of a photo interruptor 62. Here, the N-value sensor 61 has the slits 63 radially provided at equal spacings, whereby the photo interruptor 62 detects the rotation of the N-value sensor 61 by detecting the light passing through the slit 63. The reduction ration from the ink sheet supply roll 17 to the encoder plate 61 is 1/2.89.

Figure 6:
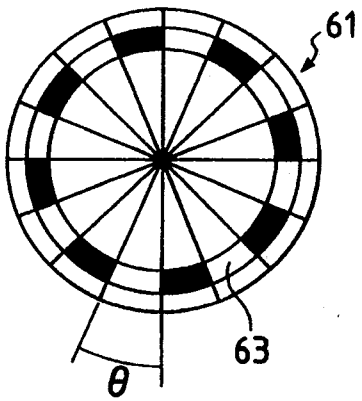
FIG. 6 is a view showing an N-value sensor in the facsimile terminal equipment in the example.

An enlarged view of the N-value sensor is shown in FIG. 6. The angle $\theta$ between slits is about 10 degrees as shown in FIG. 6.

As the recording sheet 11 and the ink sheet 14 are conveyed in mutually opposite directions, the longitudinal direction of the recording sheet 11 (the direction of arrow a, or the direction opposite to a direction of conveying the recording sheet 11) in which an image is recorded successively and the conveyance direction of the ink sheet 14 are coincident. Here, if the conveying speed $V_p$ of the recording sheet 11 is $V_p=-n\cdot V_I$ ($V_I$ is a conveying speed of the ink sheet 14, and a sign − indicates that the recording sheet 11 and the ink sheet 14 are conveyed in opposite directions ), the relative speed $V_{PI}$ of the recording sheet: 11 and the ink sheet 14 to the thermal head 13 can be represented by $V_{PI}=V_P-V_I=(1+1/n)V_P$, which is greater than $V_P$.

Thus, it will be found that the relative speed $V_{PI}$ is greater than the relative speed $V_{PI}$ $(=(1-1/n)V_P)$ when the recording sheet and the ink sheet are conveyed in the same direction as conventionally practiced.

In addition, there is a method in which when n lines are recorded with the thermal head 13, the ink sheet 14 is conveyed in the direction of arrow a by the amount of (s/p) for each (n/p) line (s, p are integers, n>p, s), or a method in which when recording for a distance corresponding to the length L, the ink sheet 14 is conveyed in the direction opposite to and at the same speed as that of the recording sheet 11 during the recording, and the ink sheet 14 is rewound by $L\cdot(n-1)/n$ $(n>1)$ before recording for the next predetermined amount. In any of those methods, the relative speed in recording with the ink sheet 14 stopped is $V_P$, while the relative speed in recording with the ink sheet 14 being moved is $2V_P$.

FIG. 1 is a diagram showing the electrical connections between the control unit 101 and the recording unit 102 in the facsimile terminal equipment of the example, wherein the common parts to other drawings are indicated with the like numerals.

The thermal head 13 is a line head. The thermal head 13 comprises a shift register 130 for inputting one line of serial recording data 43 from the control unit 101 in synchronism with a shift clock, a latch circuit 131 for latching data of the shift register 130 with a latch signal 44, and a heat generating element 132 composed of one line of heating resistors. Here, the heating resistors 132 are divided into m blocks as indicated by 132-1 to 132-m to be driven.

133 is a temperature sensor for detecting the temperature of the thermal head 13, which is mounted on the thermal head 13. An output signal 42 of the temperature sensor 133 is converted from analog to digital form within the control unit 101 and input into the CPU 113. Thereby, the CPU 113 can detect the temperature of the thermal head 13 so as to alter the applied energy to the thermal head 13 in accordance with the characteristics of the ink sheet 14 by changing the pulse width of a strobe signal 47 in correspondence to its temperature, or changing the driving voltage of the thermal head 13.

It should be noted that the characteristic (or type) of ink sheet 14 can be determined by a switch **103*a* as previously described. The type or characteristic of the ink sheet 14 may be determined by detecting a mark printed on the ink sheet 14**, or a mark or cut-out attached to a cartridge for the ink sheet.

116 is a programmable timer in which the timer is set by the CPU 113 and started if the start of timer is instructed. And it operates to output an interrupt signal or time-out signal to the CPU 113 at each indicated timing. This timer 116 allows the conduction time of electricity to the thermal head 13 to be measured. 46 is a driving circuit for inputting a drive signal for the thermal head 13 from the control unit 101, and outputting a strobe signal 47 for driving the thermal head 13 for each block. It should be noted that this driving circuit 46 can change the amount of energy applied to the thermal head 13 by changing the voltage output to a power source line 45 for supplying current to the heating elements (resistors) 132 within the thermal head 13, with an indication from the control unit 101. 48 and 49 are driver circuits for driving and rotating a recording sheet conveying motor 24 and an ink sheet conveying motor 25, respectively. It should be noted that each of recording sheet conveying motor 24 and ink sheet conveying motor 25 is a stepping motor in this example, but not limited to it, and may be a DC motor, for example. 38 is an ink sheet exchange detection unit for detecting that the ink sheet 14 has been exchanged, which is engaged with a lever for attaching or detaching the ink sheet, and notifies the control unit 101 that the ink sheet is exchanged by outputting a pulse signal when the ink sheet 14 is exchanged. The driver circuit 48 drives and rotates the recording sheet conveying motor 24 by switching the excitation phase of the recording sheet conveying motor 24 with an instruction from the control unit 101.

Since the recording sheet 11 is conveyed by the platen roller 12 which is rotated by the recording sheet conveying motor 24, the conveyance amount of the recording sheet 11 to be conveyed when the recording sheet conveying motor 24 is rotated by a predetermined amount is constant at all times. On the contrary, since the ink sheet 14 is conveyed by controlling the rotation number for the take-up roll 18 which is rotated by the ink sheet conveying motor 25, the amount of conveying the ink sheet 14 may be different depending on the amount of ink sheet 14 (diameter of the take-up roll 18) would around the ink sheet take-up roller 18 even if the ink sheet conveying motor 25 is rotated by a predetermined number.

As the method of maintaining the amount of taking up the ink sheet 14 constant at all times, regardless of the diameter of the take-up roll 18, there are two methods as shown in the following.

Suppose that the core diameter of the take-up roll 18 for the ink sheet 14 is $r_1$, and the diameter of the take-up roll 18 when the ink sheet 14 is wound by a predetermined amount is $r_2$. Here, the amount of conveying the ink sheet 14 when the take-up roll 18 is rotated by a predetermined angle $\theta$ is $r_1\theta$ immediately after starting the take-up, and $r_2\theta$ when a predetermined amount of ink sheet 14 is wound around the take-up roll 18. As the multi print is controlled so that when the recording sheet 11 is conveyed by one line, the ink sheet 14 is conveyed by 1/n line, it is sufficient to select the number of driving steps for the ink sheet conveying motor 25 such as $p_1: p_2 = r_2: r_1$, by checking the diameter of the take-up roll 18 with the sensor 23 as shown in FIG. 3. Note that the least step angle $\theta$ for the ink sheet conveying motor 25 is constant.

Another method is such that the angle $\theta$ is set such as $\theta_1: \theta_2 = r_2: r_1$, by changing the least step angle in accordance with the amount of taking up the ink sheet 14, with the driving at micron steps.

In addition, the method of controlling the amount of conveying the ink sheet 14 to be substantially constant is accomplished in such a way as to calculate the diameter of the ink sheet take-up roll 18, based on the rotation number of the take-up roll 18 since the ink sheet 14 has been loaded. Assuming the thickness of the ink sheet 14 to be t, and the rotation number of the take-up roll 18 to be p, its diameter is given by $(r_1+pt)$. In this way, it is possible to control the conveyance of the ink sheet 14 while calculating the diameter of the take-up roll 18.

With this method, it is sufficient to initialize the calculated value of the diameter as above mentioned to $r_1$ when the exchange of the ink sheet 14 is detected by the exchange detection unit 38. However, when an ink sheet roll having different diameter is loaded, or the ink sheet during the use is once unloaded and reloaded, it may be initialized by mistake.

In addition, an example in which the amount of conveying the ink sheet 14 relative to the recording sheet 11 is controlled to be substantially constant with the conveyance amount of the ink sheet 14 being constant will be described in the following.

First, the N-value control will be described.

Here, the N-value is represented by N=(moving amount of recording sheet 11)/(moving amount of ink sheet 14). The moving amount of the recording sheet 11 is constant as it is moved with the rotation of the platen roller 12 as previously described. On the other hand, as the ink sheet 14 is taken up by the rotation of tile support shaft for the take-up roll 18, the moving amount of the ink sheet 14 relative to a predetermined rotation amount of this support shaft varies depending on the take-up diameter of the ink sheet take-up roll 18. Accordingly, the length of ink sheet to be conveyed when the ink sheet conveying motor 25 is rotated by a predetermined amount is larger with increasing take-up diameter of the ink sheet take-up roll 18, whereby the number N of the multi print is decreased. With the variation of the N-value, the density or resolution of the recording image is varied. That is, if the N-value is larger, the number of recordings with the same portion of the ink sheet is increased, so that the recording density is thinner, while if the N-value is smaller, the resolution tends to be collapse.

Accordingly, in order that the image quality of recording may be excellent and uniform from the starting of the ink sheet cartridge to its termination, the excitation pulse for the ink sheet conveying motor 25 is changed halfway (e.g., two stages). That is, when the take-up diameter of the ink sheet take-up roll 18 is $\phi$ 22 to $\phi$ 31.5 (mm), the ink sheet conveying motor 25 is driven by three half steps when recording for one line in the super fine mode. Also, when the take-up diameter of the ink sheet take-up roll 18 is $\phi$ 31.5 to $\phi$ 44 (mm), the ink sheet conveying motor 25 is driven by two half steps when recording for one line in the super fine mode. In this way, the number of steps for conveying the ink sheet 14 when recording for one line in the super fine mode is changed, depending on whether or not the take-up diameter of the ink sheet is greater than $\phi$ 31.5 mm, which will be further described below.

First, the relation between the N-value and the take-up diameter of the ink sheet take-up roller 18 will be described belong.

When recording for one line in the super fine mode, the ink sheet 14 is conveyed by (1/15.4N)mm. The rotation angle around the rotation shaft of the ink sheet take-up roller 18 is $$\{(1/15.4N)/(D/2)\}\times(180^\circ/\pi)\ \text{(degrees)} \quad (1)$$

for an ink sheet take-up diameter D, because of $(r\cdot\Delta\theta=\Delta s)$, therefore, $(\Delta\theta=\Delta s/r)$.

On the other hand, if the ink sheet conveying motor 25 having a step angle of $\theta^\circ$ is excited by a pulses, with 1-2 phase excitation ( half step angle of $(\theta^\circ/2)$) and a reduction ratio i, the rotation angle of the rotation shaft for the ink sheet take-up roller 18 is obtained such as $$(\theta^\circ/2)\times(a/i)\ \text{(degrees)} \quad (2)$$

From (1) expression=(2) expression.

$$\{(1/15.4N)/(D/2)\times(180^\circ/\pi)=(\theta^\circ/2)\times(a/i),$$

$$N=(720^\circ xi)/(15.4\pi a\ \theta^\circ)\times(1/D) \quad (3)$$

Since i=44.13, $\theta=1.8^\circ$, and a=2 or 3, $$N=31773.6/87.0408\cdot a\cdot D=365.04/(a\cdot D) \quad (4)$$

Figure 5:
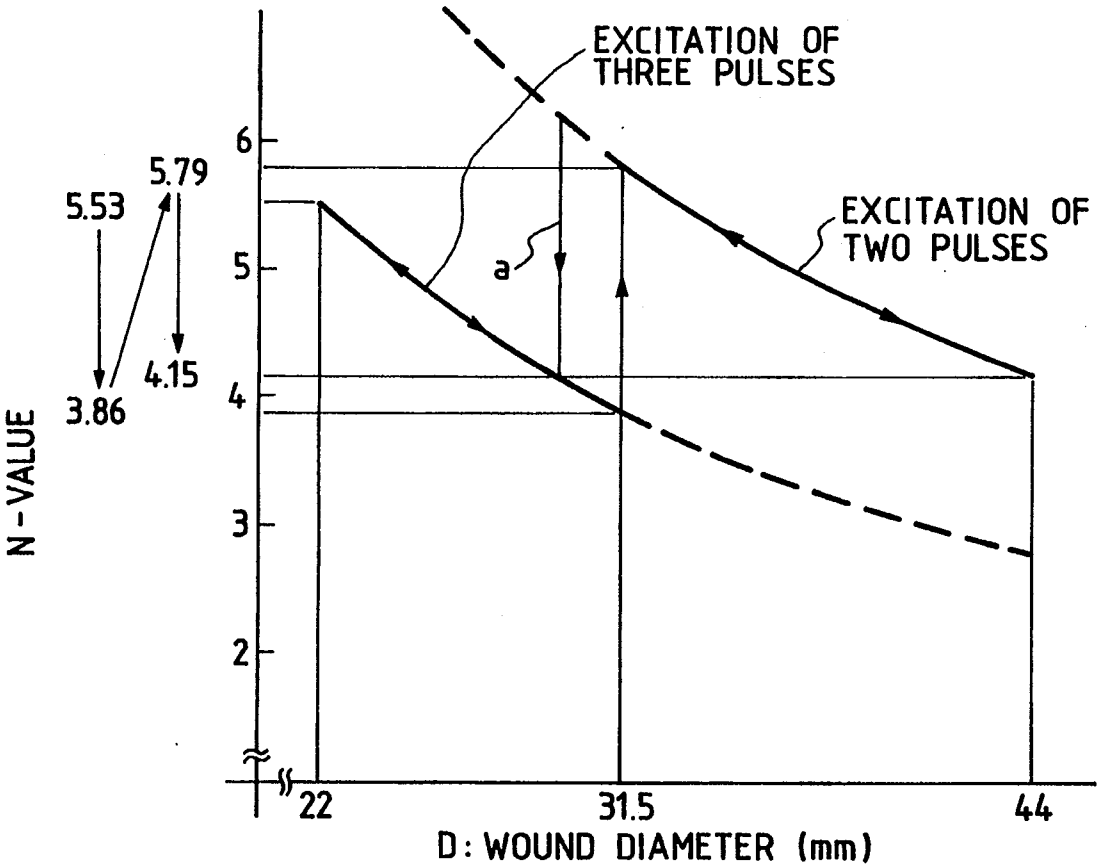
FIG. 5 is a graph representing the variation of N-value relative to the take-up diameter of ink sheet in the facsimile terminal equipment in the example.

FIG. 5 is a graph showing the variation of the N-value relative to the take-up diameter of the ink sheet take-up roll 18. In FIG. 5, the axis of abscissas indicates the take-up diameter of the ink sheet take-up roll 18, and the axis of ordinates indicates the N-value.

At the beginning of the ink sheet 14, the take-up diameter D of the take-up roll 18 is 22 mm, in which the ink sheet conveying motor 25 is conveyed by three half steps when recording for one line in the super fine mode. By substituting a=3, D=22 (mm) into the above expression (4), the N-value at the begining of the use is N=(365.04/3×22), i.e., N≃5.53. The N-value becomes smaller with increasing take-up diameter of the ink sheet take-up roll 18. Here, the rotation angle of the ink sheet conveying motor 25 when recording for one line in the super fine mode is set to be two half steps. How to obtain the take-up diameter D of the ink sheet take-up roll 18 at N=3.86 will be described below.

First, by substituting a=3, N=3.86 into D=(365.04/aN) in the expression (4), the diameter D of the ink sheet take-up roll 18 at N=3.86 is obtained as D≃31.5 (mm). Thus, after the take-up diameter of the ink sheet take-up roll 18 reaches 31.5 (mm), the ink sheet 14 is conveyed by driving the ink sheet conveying motor 25 by two half steps, when recording for one line in the super fine mode. Then, the N-value becomes also smaller with increasing take-up diameter of the ink sheet. Since the diameter of the ink sheet take-up roll 18 at the termination of the ink sheet 14 is about 44 mm, the N-value at the termination is $N=(365.04/2\times 44)\simeq 4.15$ by substituting $a=2$, $D=44$ (mm).

The relation between the take-up diameter D of the ink sheet take-up roll 18 and the diameter of the ink sheet supply roll 17 will be described below.

The diameter D of the ink sheet take-up roll 18 when the ink sheet 14 having a thickness of t(μm) is taken up by L(m) around a take-up shaft of the ink sheet take-up roll 18 having a take-up diameter of d(mm) is, $$\pi(D/2)^2-\pi(d/2)^2=tL$$

$$(D/2)^2=tL/\pi+(d/2)^2$$

$$D=2\cdot\mathrm{SQRT}(tL/\pi+(d/2)^2\ (\mathrm{mm}) \tag{5}$$

owing ($\pi r_1^2-r_0^2=tL$ : $r_1$ is a diameter after being taken up, find $r_0$ is a diameter before being taken up). Where SQRT(x) indicates a square root of x.

On the other hand, on the side of the ink sheet supply roll 17, supposing that the diameter of the supply roll 17 at the beginning of the ink sheet 14 is Ds (mm), the total length of the ink sheet 14 is $L_M$, the thickness of ink sheet before the use is $t_s$(μm) and the diameter of the supply shaft for the ink sheet supply roll 17 is $d_s$, $$\pi(D_s/2)^2-\pi(d_s/2)^2=t_s\cdot L_M \tag{6}$$

owing to ($\pi r_1^2-\pi r_0^2=tL$) as previously shown.

And supposing that the diameter of the ink sheet supply roll 17 when the ink sheet 14 is used by L(mm) is $D_{sp}$, $$\pi(D_{sp}/2)^2-\pi(d_s/2)^2=t_s\cdot(L_M-L)$$

$$(D_{sp}/2)^2=\{t_s\cdot(L_M-L)\}/\pi+(d_s/2)^2$$

$$D_{sp}=2\cdot\mathrm{SQRT}[\{t_s\cdot(L_M-L)\}/\pi+(d_s/2)^2](\mathrm{mm}) \tag{7}$$

Transforming the expression (5), $$L=\{(D/2)^2-(d/2)^2\}\pi/t$$

Transforming the expression (6), $$L_M=\{(D_{sp}/2)^2-(d_s/2)^2\}\pi/t_s$$

Substituting the above expressions into the expression (7), $$D_{sp}=2\cdot\mathrm{SQRT}[(t_s/\pi)\{(D_{sp}/2)^2-(d_s/2)^2\}(\pi/t_s)-(\pi/t)\{(D/2)^2-(d/2)^2\}+(d_s/2)^2]=2\cdot\mathrm{SQRT}[(D_{sp}/2)^2-\{(D/2)^2-(d/2)^2\}(t_s/t)]$$

Here, supposing $t=t_s$, $D_{sp}=44$ (mm) and $d=22$ (mm), $$D_{sp}=2\cdot\mathrm{SQRT}\{(44/2)^2-\{(D/2)^2-(22/2)^2\}=2\cdot\mathrm{SQRT}\{605-(D/2)^2\} \tag{8}$$

Next, the relation between the take-up diameter of the ink sheet take-up roll 18 and the number of lines for rotating the N-value sensor 61 provided on a rotation shaft of the ink sheet supply roll 17 for a predetermined angle in the super fine mode (more specifically the number of driving steps for the ink sheet conveying motor ? 5) will be described below.

Supposing the take-up diameter of the ink sheet take-up roll 18 to be D(mm), the moving amount of the ink sheet 14 when recording for one line in the super fine mode is $$2\pi(D/2)\cdot(1.8/360)\cdot(\tfrac{1}{2})\cdot(1/44.13)\cdot n \tag{9}$$

Where n is the number of conveying steps ( e.g., 2 or 3) for the ink sheet conveying motor 25 when recording for one line in the super fine mode.

On the other hand, supposing the roll diameter of the ink sheet supply roll 17 to be $D_s$ and the rotation angle of the N-value sensor when conveying the ink sheet 14 by s(mm) to be α(°), $$2\pi(D_s/2)\cdot(\alpha/360)\cdot(18/52)=s \tag{10}$$

where "18/52" shows the ratio of the tooth number (52) of the ink sheet supply roll 17 to the tooth number (18) of the N-value sensor 61. From the expressions (8), (9) and (10), the number of lines (m lines) necessary for rotating the N-value sensor 61 by α° in the super fine mode is $$2\pi(D_s/2)\cdot(\alpha/360)\cdot(18/52)=2\pi(D/2)\cdot(1.8/360)\cdot(\tfrac{1}{2})\cdot(1/44.13)\cdot n\cdot m\alpha D_s\cdot(18/52)=D\cdot(1.8)\cdot(\tfrac{1}{2})\cdot(1/44.13)\cdot n\cdot m$$

Substituting the expression (8), $$\alpha.2\mathrm{SQRT}\{605-(D/2)^2\}\times(18/52)=1.8Dx(\tfrac{1}{2})\times(1/44.13)\mathrm{nm}$$
$$\mathrm{nm}=2\alpha\mathrm{SQRT}\{605-(D/2)^2\times(18/52)/\{1.8Dx(\tfrac{1}{2})\times(1/44.13)\pi \tag{11}$$

Here, supposing the slit angle of the N-value sensor 61 to be 10°, $$\mathrm{nm}\simeq 339.5\cdot\mathrm{SQRT}\{605-(D/2)^2\}/D \tag{12}$$

When a new cartridge having the ink sheet 14 all wound around the supply roll 17 is used (or the ink sheet conveying motor 25 is driven by three half steps in recording for one line in the slider fine mode), the timing at when the ink sheet conveying motor 25 is switched to the two half step driving in recording for one line in the super fine mode is when the N-value reaches 3.86 as previously described, that is, when the take-up diameter of the ink sheet take-up roll 18 reaches 31.5 mm. When the take-up diameter reaches 31.5 mm, the number of lines necessary for rotating the N-value sensor 61 by 10° in the super fine mode is $$m=(339.5/3)\cdot\mathrm{SQRT}\{605-(31.5/2)^2\}/31.5=67.87(\mathrm{lines})$$

Thereby, when the number of lines necessary for rotating the N-value sensor 61 by 10° in the super fine mode is equal to or less than 68 lines, it is sufficient to switch the ink sheet conveying motor 25 to the two half driving, when recording for one line in the super fine mode, in the recording operation following the next page.

Once the ink sheet conveying motor 25 is switched to the two half Steps driving, when recording for one line in the super fine mode, this ink sheet conveying method can be used. However, when the driving for the ink sheet conveying motor 25 should be three half steps when recording for one line in the super fine mode, assume that a false judgement would be made as two half steps, When the take-up diameter of the ink sheet take-up roll 18 is 31.5 mm, the number of lines necessary for rotating the N-value sensor 61 by 10° in the super fine mode with two half steps of the ink sheet conveying motor 25 when recording for one line in the super fine mode is $$m=(339.5/2)\cdot SQRT\{605-(31.5/2)^2\}/31.5=101.81\text{-(lines)}$$

Here, assume that the number of lines necessary for rotating the N-value sensor 61 by 10° in the super fine mode in order to return the driving for the ink sheet conveying motor 25 from two half steps to three half steps, when recording for one line in the super fine mode is equal to or greater than 102 lines. Thus, the image quality of recording may be varied for each page, when the take-up diameter of the ink sheet take-up roll 18 is about 31.5 mm, and the driving for tile ink sheet conveying motor 25 is switched from two half steps to three half steps when recording for one line in the super fine mode.

Therefore, the number of lines necessary for rotating the N-value sensor 61 by 10° in the super fine mode in order to return the driving for the ink sheet conveying motor 25 from two half steps to three half steps when recording for one line in the super fine mode is set to be equal to or greater than 112 lines by providing 10 percent of margin. That is, a hysteresis characteristic is given as shown by a in FIG. 5.

Then, the take-up diameter of the ink sheet 14 is, from the expression (12), $$(nmD/339.5)^2=605-(D/2)^2$$

Here, with n=2, m=112, $$\{(2.112/339.5)^2+(\tfrac{1}{2})^2\}D^2=605$$

Thereby, D=29.71 mm is obtained, and it can be found that a more hysteresis characteristic is given, as compared with a case of 31.5 mm as previously shown.

Next, the detection for the disconnection of the ink sheet 14, which can be considered as one cause for an instance where the ink sheet supply roll 17 is not rotated even if the ink sheet take-up roll 18 may be rotated, will be described below.

There are following instances for judging the disconnection of the ink sheet 14.

(1) An instance where the status (output signal) of the N-value sensor 61 is not changed, even if the ink sheet conveying motor 25 is rotated by 1596×8 half steps in removing the slackness of ink sheet 14. The number of steps for conveying the ink sheet conveying motor 25 necessary for rotating the N-value sensor 61 by a slit angle of 10° is, $$339.5\times SQRT\{605-(22/2)^2\}/22=339.5\text{(half steps)}$$

from the expression (12), when the take-up diameter D of the ink sheet take-up roll 18 is 22 mm (at the beginning of the ink sheet 14). When the take-up diameter D of the ink sheet take-up roller 18 is 44 mm (at the termination of the ink sheet 14), $$339.5\times SQRT\{605-(44/2)^2\}/44=84.9\text{ (half steps)}$$

In this way, the status of the N-value 61 may be changed at least 1596×8/339.5=37.6 (times) if the ink sheet conveying motor 25 is rotated by 1596×8 half steps. If the status of the N-value 61 is not changed in this case, the disconnection of the ink sheet 14 can be judged.

(2) An instance where the status of the N-value sensor 61 is not changed, even if 680 lines are recorded, for example, in recording the line information.

The minimum value of status change in the N-value sensor 61 occurs when the ink sheet conveying motor 25 is driven by two half steps, in the super fine mode, and in recording for one line of the super fine mode. At this time, the ink sheet 14 is conveyed by 680×2 half steps for the recording of 680 lines. Therefore, the status of the N-value sensor 61 ought to be changed by 680×2/339.5=4.01 times at minimum. Note that when the ink sheet conveying motor 25 is rotated with two half steps, the take-up diameter of the ink sheet take-up roll 18 does not become 22 mm. Hence, if the ink sheet conveying motor 25 is driven by three half steps, the status of the N-value sensor 61 will be changed more times. A reasonable value., for the number of lines in the super fine mode when the N-value sensor 61 is rotated by 10° is as for lows.

From the expression (12), when the ink sheet conveying motor 25 is rotated by two half steps when recording for one line in the super fine mode, $$m=(339.5/2)\times SQRT\{605-(22/2)^2\}/22=169.8\text{ (lines) (lines)}$$

if the take-up diameter of the ink sheet take-up roll 18 is 22 mm, and $$m=(339.5/2)\times SQRT\{605-(44/2)^2\}/44=42.4\text{ (lines)}$$

if the take-up diameter of the ink sheet take-up roll 18 is 44 mm. Considering a reasonable 10 percent of margin, a range from 28.3×0.9=25.2 (25 lines) to 169.8×1.1=186.8 (187 lines) is dealt with.

The length of conveying the ink sheet 14 after the slackness removal of ink sheet is terminated is obtained. The number of driving steps for the ink sheet conveying motor 25 when the ink sheet 14 is conveyed in removing the slackness of ink sheet is 24×8 steps. Therefore, from the expression (9), $$2\pi\cdot(22/2)\cdot(1.8/360)\cdot(\tfrac{1}{2})\cdot(1/44.13)\cdot 24\cdot 8=0.752\text{ (mm)}$$

if the take-up diameter of the ink sheet take-up roll 18 is 22 mm, $$2\pi\cdot(44/2)\cdot(1.8/360)\cdot(\tfrac{1}{2})\cdot(1/44.13)\cdot 24\cdot 8=1.504\text{ (mm)}$$

if the take-up diameter of the ink sheet take-up roll 18 is 44 mm.

Next, the minimum value of the change number of statuses in the N-value sensor 61 in the N-value automatic determination control can be obtained as follows.

The number of steps for conveying the ink sheet conveying motor 25 necessary to rotate the N-value sensor 61 by a slit angle of 10° is at maximum when the take-up diameter of the ink sheet take-up roll 18 is 22 mm, from the expression (12). Then, 339.5×SQRT{605−(22/2)²56 /22=339.5 (half steps) Therefore, if the ink sheet conveying motor 25 is rotated by 234×8 steps, 234×8/339.5=5.51 (times), and thus the status of the N-value sensor 61 will be changed at least 5 to 6 times,.

Based on each condition as above described, the switching for the number of driving steps for the ink sheet conveying motor 25, and the judgment process of the disconnection for the ink sheet 14, will be described below.

Operation explanation ( FIG. 1, FIGS. 7 to 16)

Figures 7, 7A:
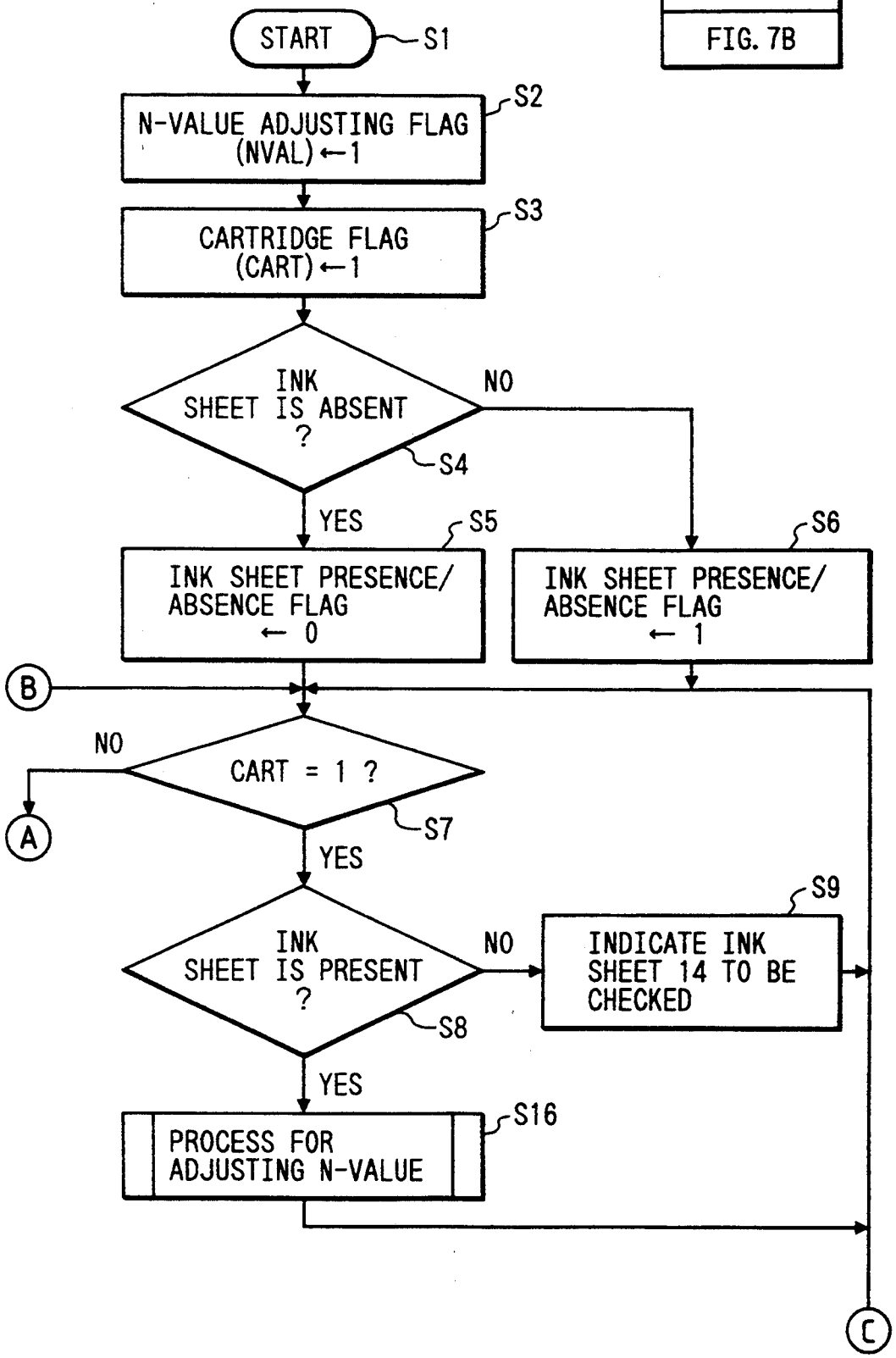
FIG. 7 is a flowchart showing the operation in the facsimile terminal equipment in the example.
Figure 7B:
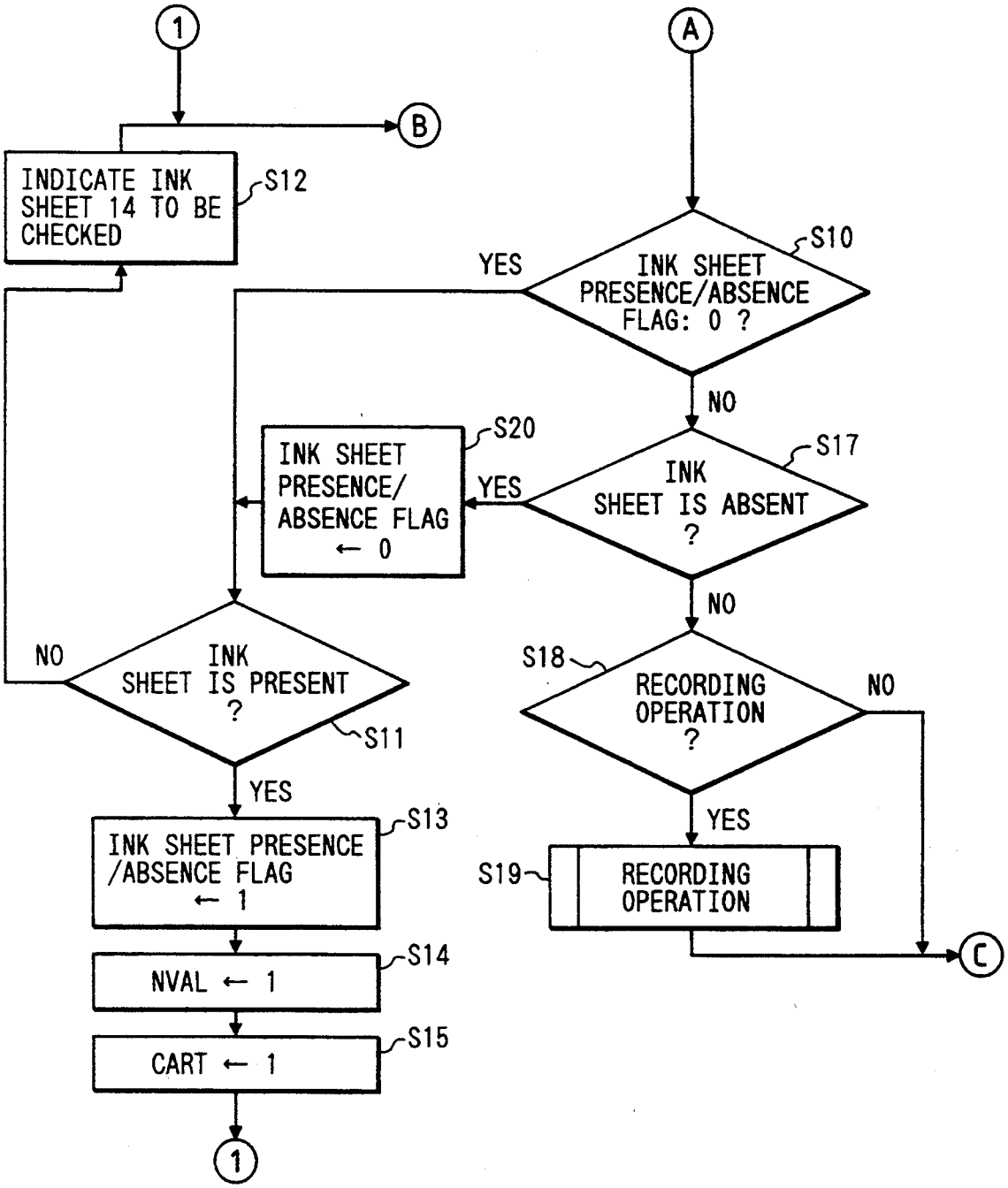

FIG. 7 is a flowchart showing the N-value control operation in the facsimile terminal equipment in this example, in which a control program with which the control unit 101 executes this process is stored in a ROM 114 of the control unit 114. In this example, the N-value control is carried out when the power of apparatus is turned on, the ink sheet is detected in turning from absent state to present state, or the recording for one page is terminated. Prior to the N-value control, the slackness of ink sheet is removed.

The detail explanation will be given below.

If the power of apparatus is turned from off to on, the operation proceeds from step S1 to step S2, where an N-value adjusting flag (NVAL) is set to be "1". Then at step S3, a cartridge flag (CART) indicating that the cartridge is exchanged is set to be "1". The value of "1" for the carriage flag (CART) means that the N-value adjustment should be made. The flag NVAL is set to be "0" if the ink sheet conveying motor 25 is conveyed by three half steps, and "1" if it is driven by two half steps, when recording for one line in the super fine mode. Thus, when the power is turned on, the ink sheet conveying motor 25 is driven by two half steps, when recording for one line.

Figure 16:
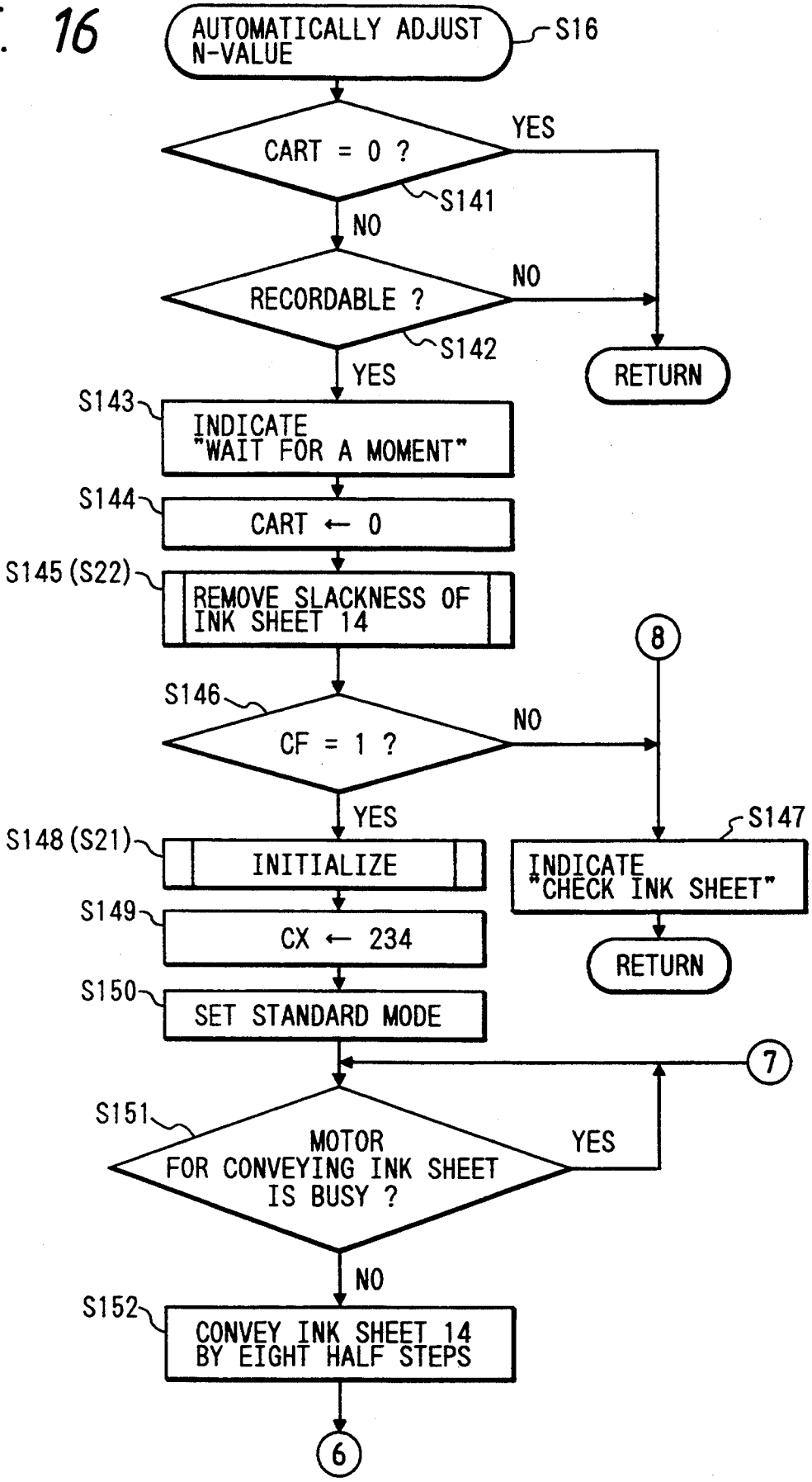
FIGS. 16 and 17 are flowcharts showing the N-value automatic control operation in the facsimile terminal equipment in the example.
Figure 17:
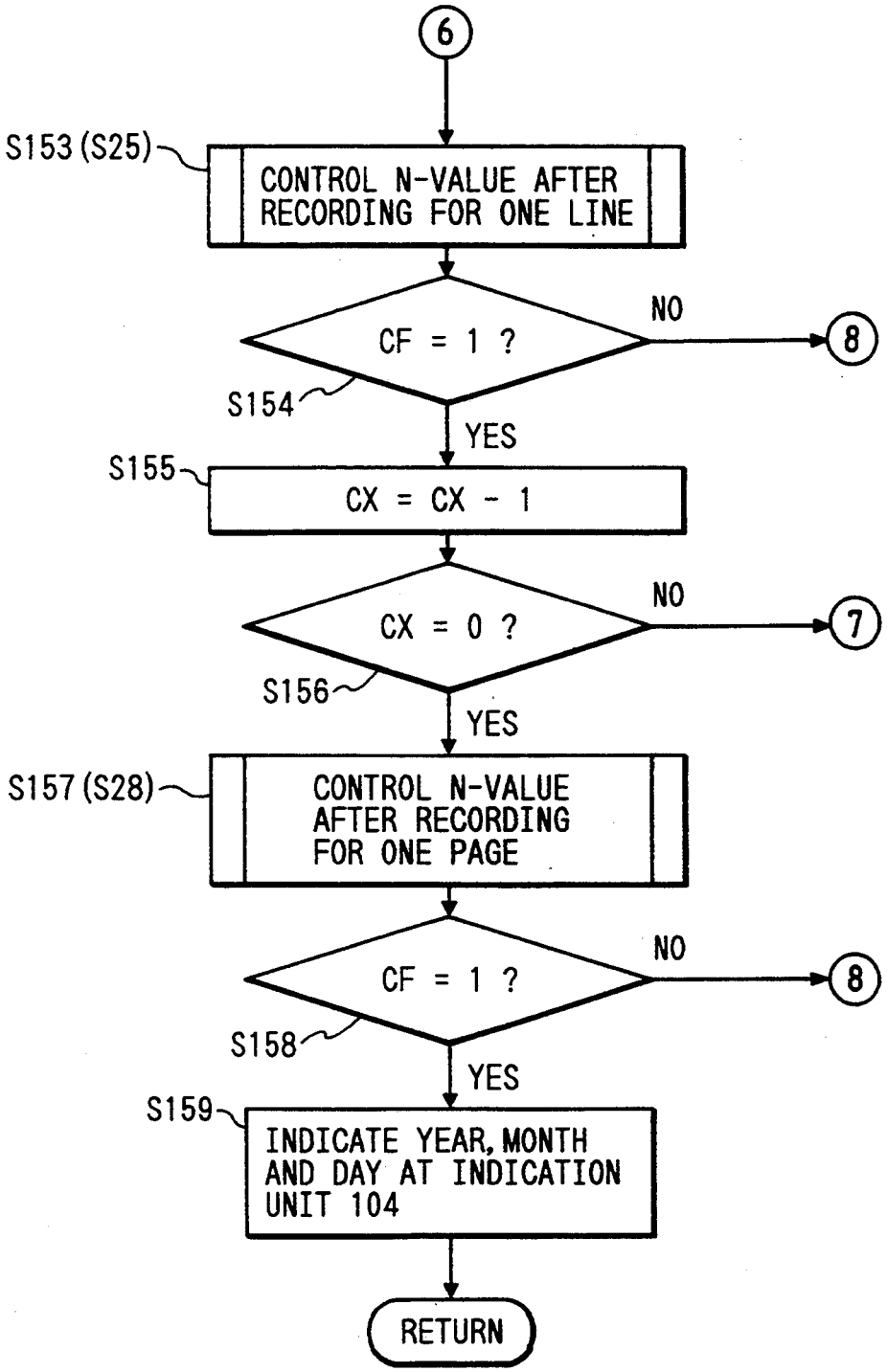

Next, if the ink sheet 14 is not set within the apparatus, the absence of the ink sheet 14 is determined based on a signal from the ink sheet sensor 20 at step S4, the operation proceeds to step S5, where the ink sheet presence/absence flag is set to be "0". At step S7, a determination is made whether or not the cartridge flag (CART) is 1. As the cartridge flag (CART) has been set to be "1" at step S3, the operation proceeds to step S8, where based on a signal from the ink sheet sensor 20, the presence or absence of the ink sheet 14 is determined. As the ink sheet 14 has not been set in this case, the operation proceeds to sheet S9, where a message of checking the ink sheet 14 is displayed on the indication unit 104, and returns to step S7. As a result, if the ink sheet cartridge is exchanged and the ink sheet sensor 20 detects that the ink sheet 14 is present, the operation proceeds from step S8 to step S16, where the N-value adjusting process is performed. The N-value adjusting process will be described later with reference to the flowcharts as shown in FIGS. 16 and 17.

After the N-value adjusting process at step S16, the operation returns to step S7. As the cartridge flag (CART) has been set to be "0" at step S144 in this case, the operation proceeds to step S10, where a determination is made whether or not the ink sheet presence/absence flag is "0". As the ink sheet presence/absence flag has been set to be "0" at step S5 in this case, the operation proceeds to step S11, where the presence or absence of the ink sheet 14 is determined, based on a signal from the ink sensor 20. As the ink sheet 14 has been set in this case, the operation proceeds to step S13, where the ink sheet presence/absence flag is set to be "1".

Then, at step S14, the N-value adjusting flag (NVAL) is set to be "1". And at step S15, the cartridge flag (CART) is set to be "1". Then the operation returns to step S7. From step S7, the operation proceeds to step S8, as the cartridge flag (CART) has been set to be "1".

At step S8, the presence or absence of the ink sheet 14 is determined, based on a signal from the ink sheet sensor 20. As the ink sheet 14 has been set in this case, the operation proceeds to step S16, where the N-value adjusting process is performed. Note that the cartridge flag (CART) has been set to be "0", as shown at step S144 in FIG. 16, in the N-value adjusting process as will be described later.

After the N-value adjusting process at step S16, the operation returns to step S7. As the cartridge flag (CART) has been set to be "0" at step S144 in this case, the operation proceeds to step S10, where a determination is made whether or not the ink sheet presence/absence flag is "0". As the ink sheet presence/absence flag has been set to be "0" at step S13 in this case, the operation proceeds to step S17, where the presence or absence of the ink sheet 14 is determined, based on a signal from the ink sensor 20. As the ink sheet 14 has been set in this case, the operation proceeds to step S18, where a determination is made whether or the start of the recording operation is instructed, in which if the recording operation is performed, the operation proceeds to step S19 for the recording operation for one page.

This recording operation will be detailed later with reference to the flowcharts as shown in FIGS. 9 to 12. On the other hand, if the start of the recording operation is not instructed at step S18, the operation returns to step S7 to wait for an indication of starting the recording operation.

Next, an instance in which the ink sheet 14 is set within the apparatus will be described.

First, at step S4, the ink sheet 14 is determined to be present, and then proceeding to step S6, the ink sheet presence/absence flag is set to be "1". From step S7, the operation proceeds to step S8 as the cartridge flag (CART) has been set to be "1" at step S3. At step S8, the presence or absence of the ink sheet 14 is determined, based on a signal from the ink sheet sensor 20. As the ink sheet 14 has been set in this case, the operation proceeds to step S16, where the N-value adjusting process is performed. Note that the cartridge flag (CART) has been set to be "0", as shown at step S144 in FIG. 16, in the N-value adjusting process as will be described later.

After the N-value adjusting process at step S16, the operation returns to step S7. As the cartridge flag (CART) has been set to be "0" at step S144 in this case, the operation proceeds to step S10, where a determination is made whether or not the ink sheet presence/absence flag is "0". As the ink sheet presence/absence flag has been set to be "1" at step S6 in this case, the operation proceeds to step S17, where the presence or absence of the ink sheet 14 is determined, based on a signal from the ink sensor 20. As the ink sheet 14 has been set in this case, the operation proceeds to step S18, where a determination is made whether or the start of the recording operation is instructed, in which if the recording operation is performed, the operation proceeds to step S19 for the recording operation for one page. When this recording process is in a copy mode, an image signal of an original read by the reading unit 100 is transmitted to its own recording unit 102, and copied. On the other hand, when this recording process is performed by the reception of a facsimile signal, an image signal transmitted from the other terminal is stored into a line memory 110, and further output to the recording unit 102 to record the image onto a recording sheet. This recording process will be described with reference to the flowcharts in FIGS. 9 to 12.

On the other hand, if the start of the recording operation is not indicated at step S18, the operation returns to step S7 to wait for an indication of starting the recording operation.

If the ink sheet 14 is determined to be absent at step S17, based on a signal from the ink sheet sensor 20, because of the disconnection of the ink sheet 14, for example, the operation proceeds to step S20, where the ink sheet presence/absence flag is set to be "0". Then, as the ink sheet 14 is absent at step S11, the operation proceeds to step S12, where a message of checking the ink sheet 14 is displayed on the indication unit 104. Then the operation returns to step S7. At step S7, a determination is made whether or not the cartridge flag (CART) is "1". As it has been set to be "0" at step S144 as previously described, the operation proceeds to step S10 to determine whether or not the ink sheet presence/absence flag is "0". As the ink sheet presence/absence flag has been set to be "0" at step S20, the operation proceeds to step S11.

If the ink sheet is still absent at step S11, the operation proceeds to step S12 and the followings, in which the same operation is repeated until a new ink sheet 14 is set.

Here, if the ink sheet sensor 20 detects that a new ink sheer 14 has been set by the exchange of the ink sheet cartridge, the ink sheet 14 is determined to be present at s ted S11, based on a detected signal, the operation proceeds to step S13, where the ink sheet presence/absence flag is set to be "1". Further, at step S14, the N-value adjusting flag (NVAL) is set to be "1", and at step S15, the cartridge flag (CART) is set to be "1". Then the operation returns to step S7, and the N-value adjusting process is continued as previously described.

Note that in the above explanation of FIG. 7, the presence or absence of the ink sheet cartridge may be determined, instead of determining the presence/absence of the ink sheet 14.

FIGS. 8 to 12 are flowcharts showing the recording operation at step S9 in the facsimile terminal equipment of this example.

Figure 9:
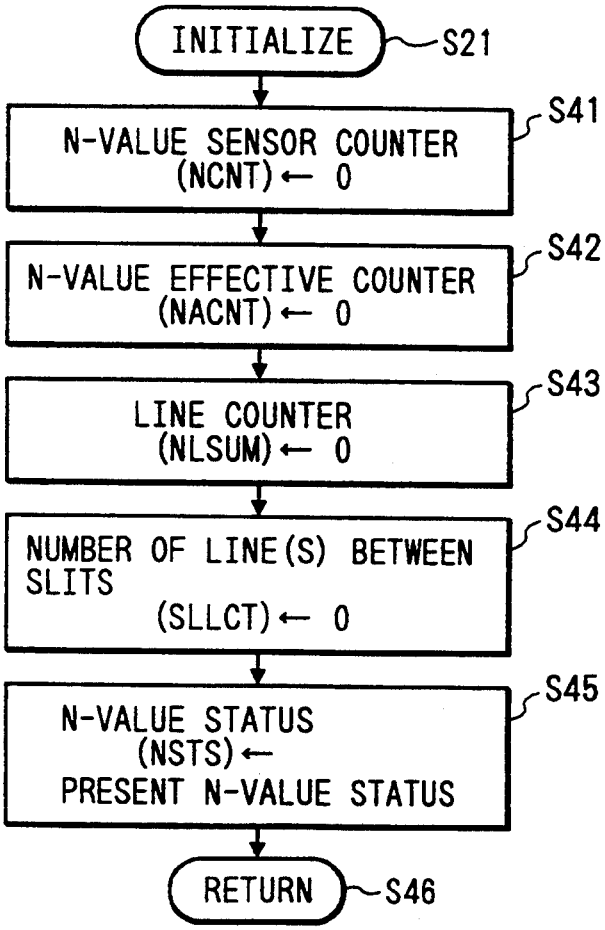
Figures 10, 10A:
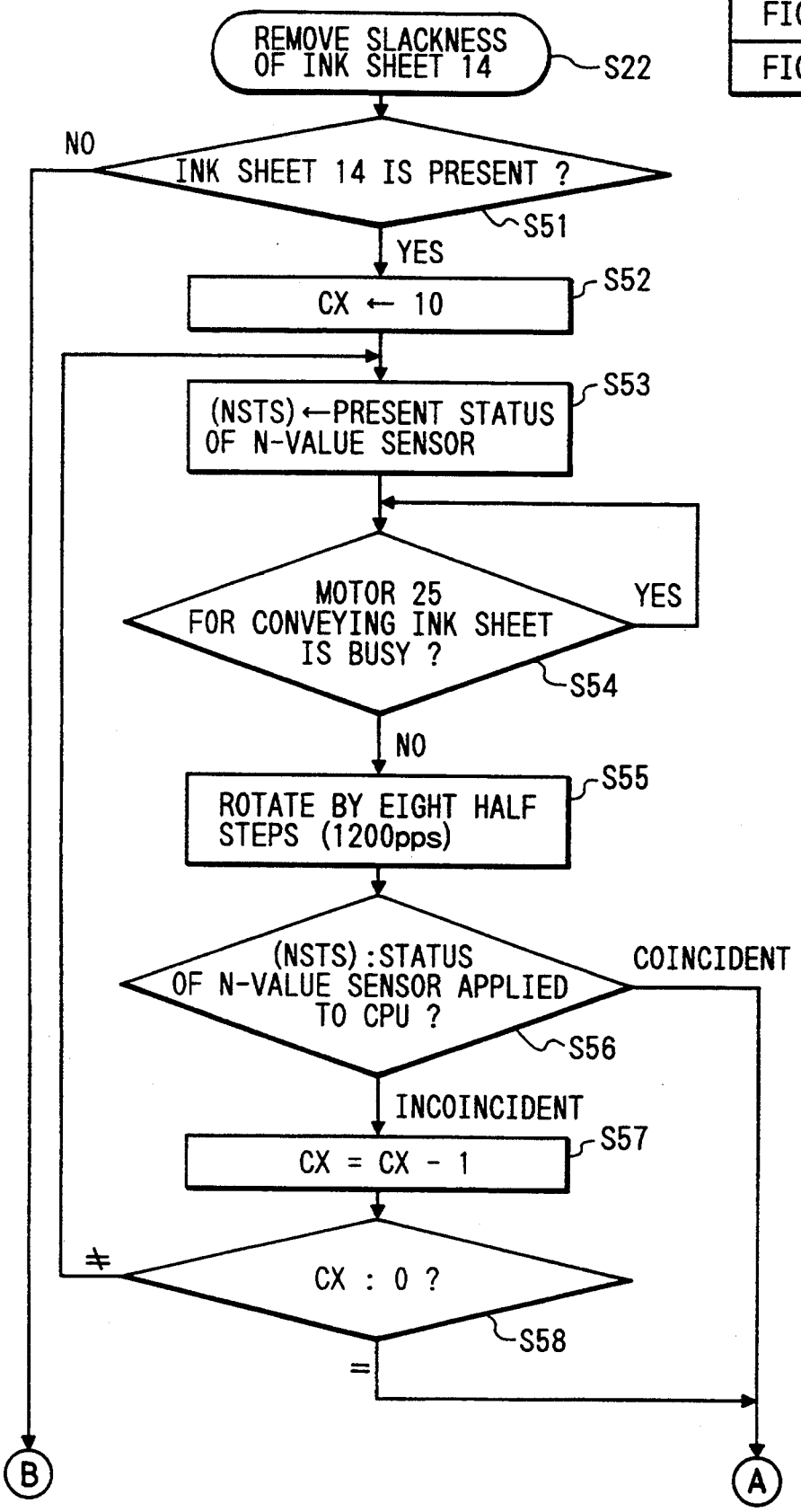
Figure 10B:
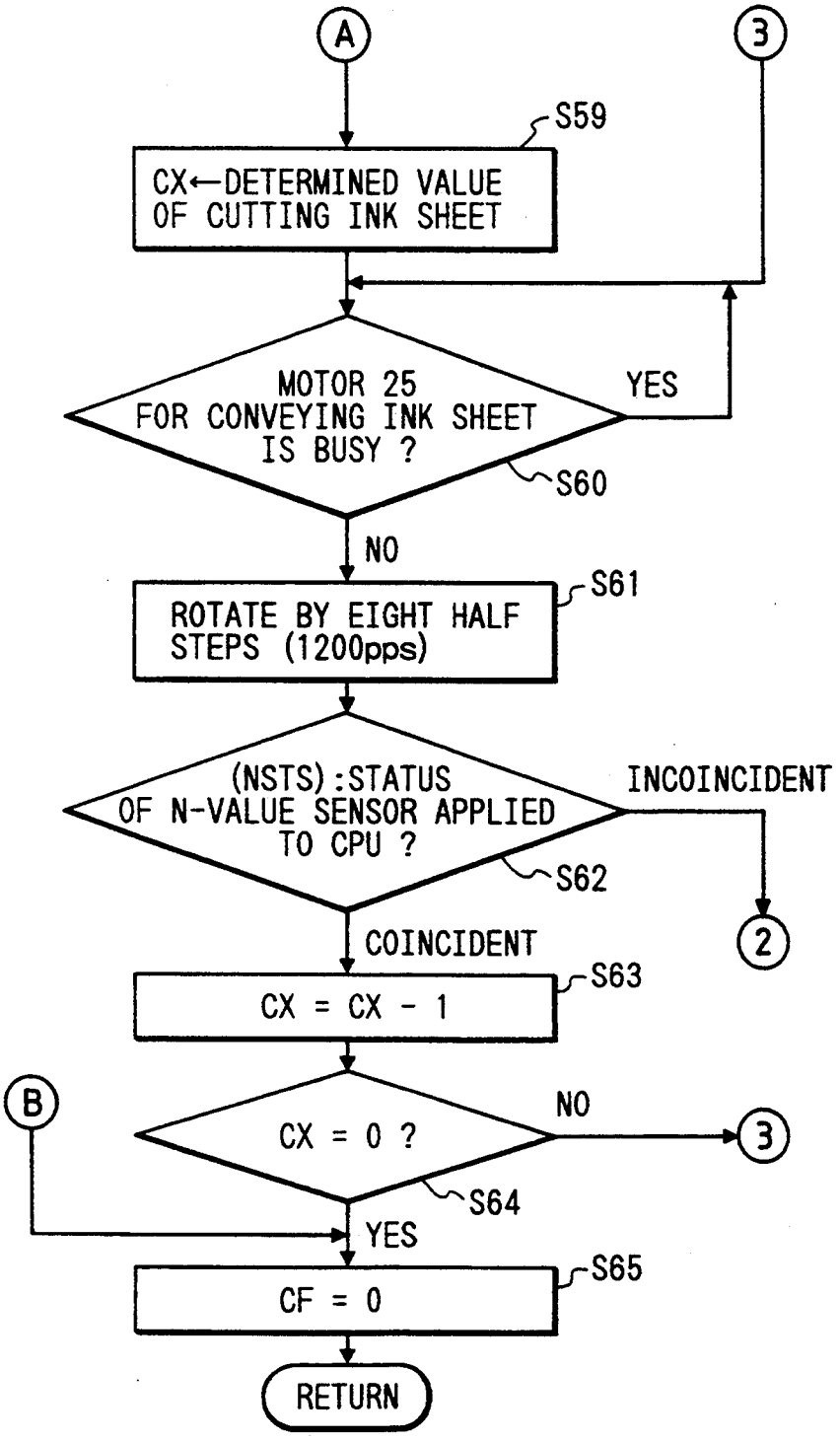
Figure 11:
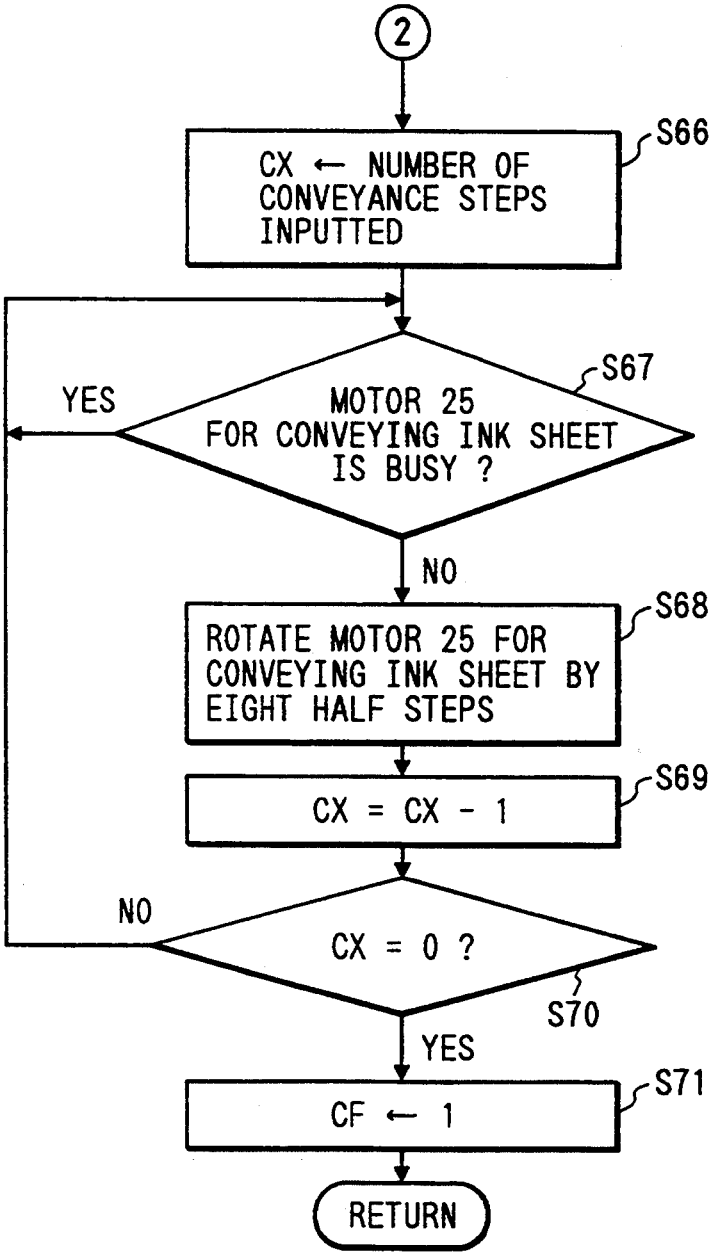

First, at step S21, the initialization is performed for each page for the N-value control, and at step S22, the slackness removal of ink sheet 14 is performed. The initialization and the slackness removal of ink sheet will be detailed with reference to the flowcharts as shown in FIGS. 9, 10 and 11. At step S23, a determination is made whether or not the slackness removal of ink sheet 14 has been successfully made, in which if it is successful, the operation proceeds to the recording process for one line at step S24, while if it is faulty, that is, the disconnection of the ink sheet is detected, the operation proceeds to step S30, where a message of checking the ink sheet 14 is displayed on the indication unit 104. The recording process at step S24 will be detailed with reference to the flowchart of FIG. 12.

At step S25, the N-value control after recording for one line (see the flowcharts of FIGS. 13 and 14) is performed. If the disconnection of the ink sheet 14 is determined at step S26, the operation proceeds to step S30, where a message of checking the ink sheet is indicated. At step S27, a determination is made whether or not the recording operation for one page is terminated. If it is not terminated, the operation returns to step S24 for the recording of next line, while if the recording for one page is terminated, the operation proceeds to step S28, where the N-value control after recording for one page (see the flowchart of FIG. 15) will be performed. If the abnormality of ink sheet 14 is detected in this process, the operation proceeds to step S30 where a message of checking the ink sheet 14 is indicated, but if not, the operation returns to the main process. In this way, the ink sheet 14 is always extended without slackness in the N-value control, by performing the N-value control after termination of the slackness removal of ink sheet 14, so that the accuracy of the N-value control can be raised.

Referring now to a flowchart of FIG. 9, the initialization process which is performed prior to the recording process for one page at step S21 will be described.

First, at step S41, an N-value sensor counter (NCNT) for counting the number of times in which the detection signal (slit signal ) detected through the Slit of the N-value sensor 61 by the photo interruptor 62 is turned from on to off or from off to on is set to be "0", and at step S42, an N-value effective counter (NACNT) for counting the effective number of times in which the slit signal of the N-value sensor 61 is turned from on to off or from off to on is set to be "0". At step S43, a line counter (NLSUM) for counting the number of lines to be recorded while the slit signal is effectively measured is set to be "0", and subsequently, at step S44, a slit-to-slit line number (SLLCT) for counting the number of lines to be recorded while the slit signal of the N-value sensor 61 is turned from on to off or from off to on is set to be "0". And finally at step S45, the current status (0 or 1) of the slit signal for the N-value sensor 61 is set to the N-value status (NSTS).

FIG. 10 is a flowchart showing the slackness removal of the ink sheet 14, which represents a slackness removal process for the ink sheet 14 to determine the amount of taking up the ink sheet 14 in correspondence to a predetermined amount of conveying the recording sheet 11 in the recording operation of the next page, after termination of the slackness removal of the ink sheet 14.

At step S51, the presence or absence for an ink sheet 14 is checked, in which if the ink sheet 14 is absent, the operation proceeds to step S65 where a flag CF is set to be "0", and returns. From steps S52 to S58, an operation of initializing a slit position for the N-value sensor 61 is performed in order to prevent a false detection caused by the unsteadiness of the N-value sensor 61 before removing the slackness of ink sheet. That is, the ink sheet conveying motor 25 is driven by eight half steps at 1200 pps (step S55), and at step S56, a comparison between a current state of the N-value sensor 61 and the state stored in (NSTS) is made. If they are equal, the operation proceeds to step S59. Note that steps S57 and S58 show a process in which the state with the value of the N-value status (NSTS) being different from a currently read value of the N-value sensor 61 occurs continuously 10 times (this does not occur in the actual case). At step S56, when the slit signal of the N-value sensor 61 does not change, that is, when the previous value (NSTS) and a currently read status of the N-value sensor 61 are identical, the operation proceeds to step S59 as the initialization of the slit position for the N-value sensor 61 has been terminated. When the ink sheet 14 is not conveyed (the value of the N-value sensor 61 is the same) even if the ink sheet conveying motor 25 is rotated in removing the slackness of ink sheet 14, the maximum number of driving steps for the ink sheet conveying motor 25 is set to a counter CX in order to determine that the ink sheet 14 is disconnected. This value is one as set with a did switch, for example, "1596" here.

At step S61, the ink sheet conveying motor 25 is rotated by eight half steps. And at step S62, a comparison is made between the value of NSTS and a current state of the N-value sensor 61. If they are equal, the processing of steps S63 and S64 is repeated until the value of the counter CX reaches "0". If the value of the counter CX reaches "0", the operation proceeds to step S65, and is terminated because of the disconnection of the ink sheet 14.

If the output state of the N-value sensor 61 is changed at step S62, the operation proceeds to step S66 to remove the slackness of the ink sheet, as the ink sheet supply roll 17 has been rotated with the rotation of the take-up roll 18. At step S66, the preset number of steps for driving the ink sheet conveying motor 25 (e.g., "24" here) is set to the counter CX. At steps S67 to S70, the ink sheet conveying motor 25 is rotated by (preset number of steps)×(eight half steps). At S71, the flag CF is set to be "1", and the operation returns to the original process. In this way, the slackness of the ink sheet 14 is completely removed. Note that the number of steps to be set at step S66 may be set with a dip switch, for example.

Figure 12:
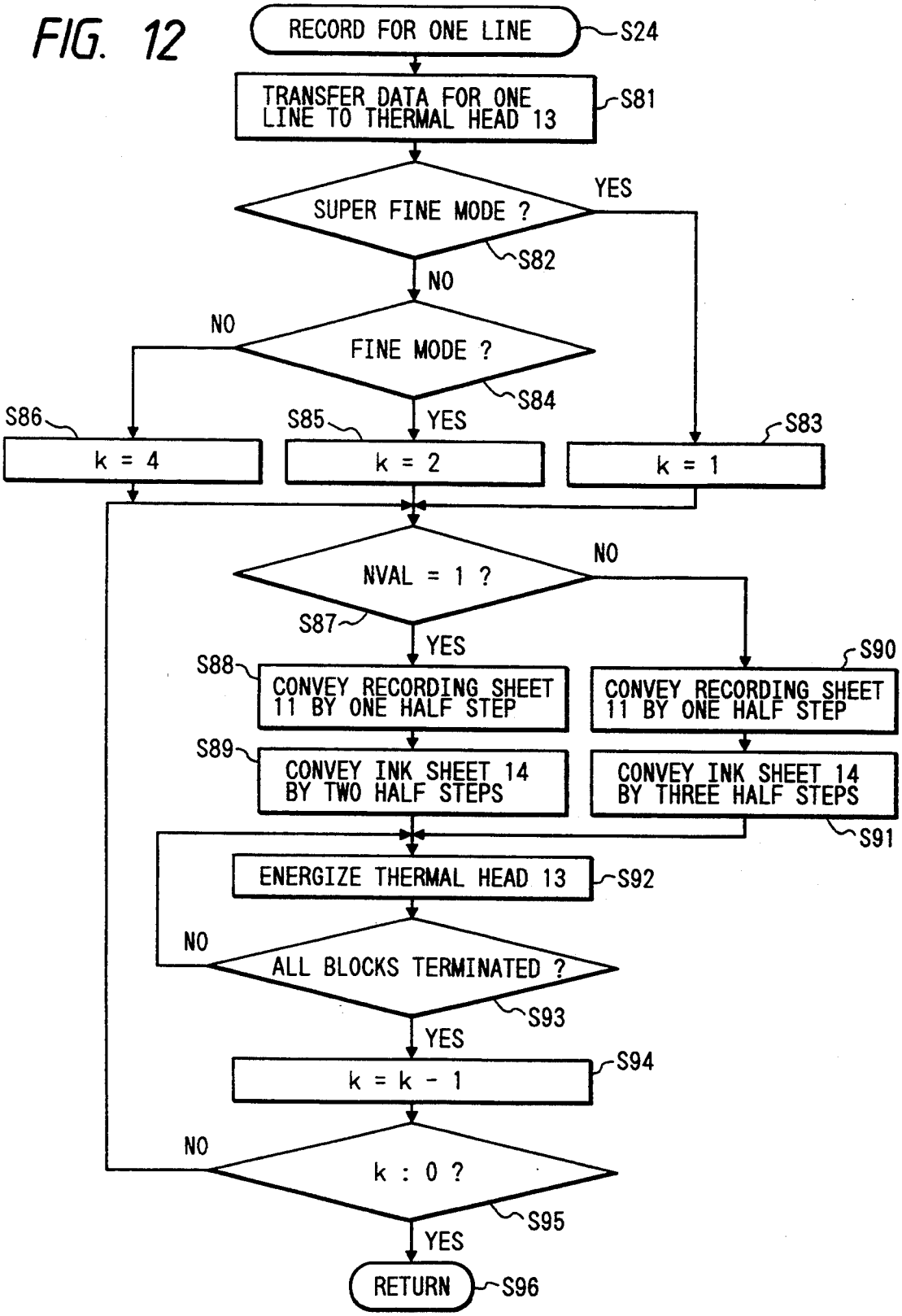

FIG. 12 is a flowchart showing the recording process for one line at step S24, which is carried out as the preparatory stage for the N-value control after recording for one page at step S28.

First, at step S81, the record data of one line is transferred to the thermal head 13, and at steps S82 to S84, the current recording mode is determined from the super fine mode, the fine mode, or the normal mode. In the super fine mode, k=1 is set at step S83, k=2 is set at step S85 in the fine mode, and k=4 is set at step S86 in the normal mode. Then, at step S87, a determination is made whether or not the N-value flag (NVAL) is "1", if it is "1", the operation proceeds to step S88, where the recording sheet conveying motor 24 is driven by one half step. And at step S89, the ink sheet conveying motor 25 is driven by two half steps. On the contrary, if the N-value flag (NVAL) is "0", the operation proceeds to steps S90 and S91, where the recording conveying motor 24 is rotated by one half step, and the ink sheet conveying motor 25 is rotated by three half steps.

Next, at step S92, the heating resistors 132 for the thermal head 13 are energized for one block. At step S93, if all the blocks (four blocks) for the thermal head 13 are energized, the operation proceeds to step S94, where k is decremented by 1. If the value of k is not "0", the operation returns to step S87, and the above-described processings are repeated. Thereby, the same line data i s recorded for two lines in succession in the fine mode, for four lines in the normal mode, and for one line in the super fine mode.

Figure 8:
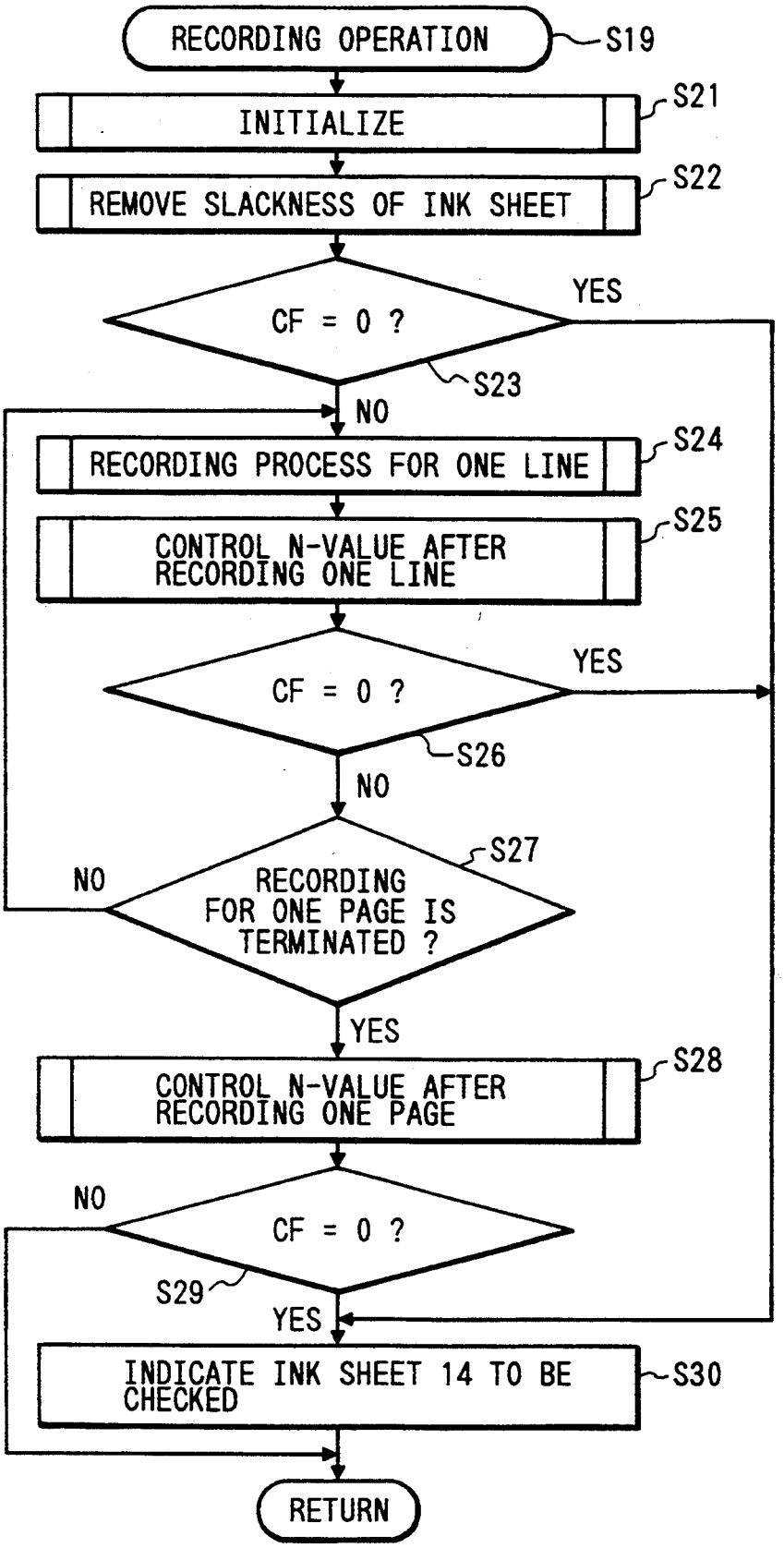
FIGS. 8, 9, 10, 11 and 12 are flowcharts showing the recording operation in the facsimile terminal equipment in the example.
Figure 13:
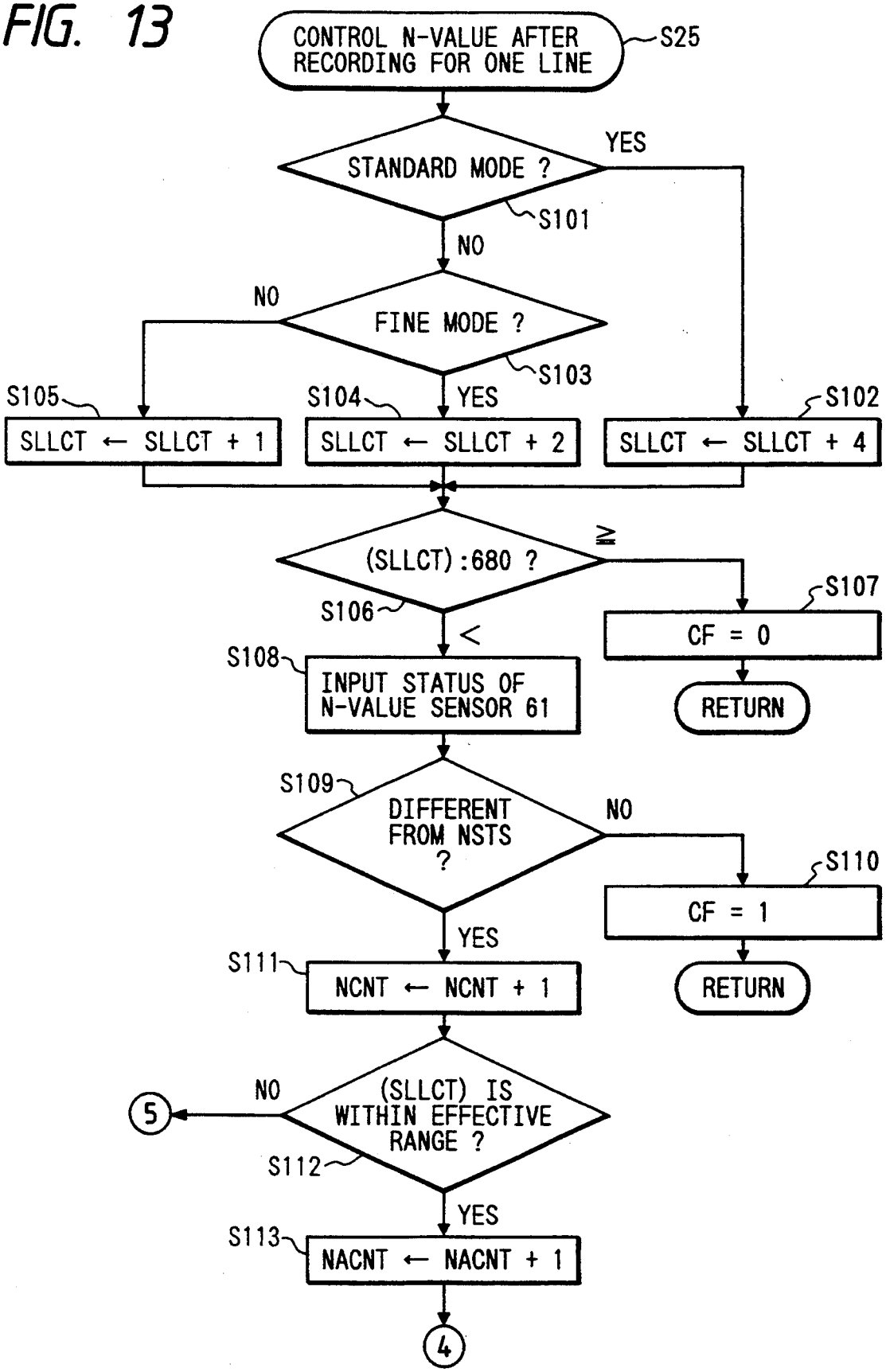
FIGS. 13 and 14 are flowcharts showing the N-value control operation after recording one line in the facsimile terminal equipment in the example.
Figure 14:
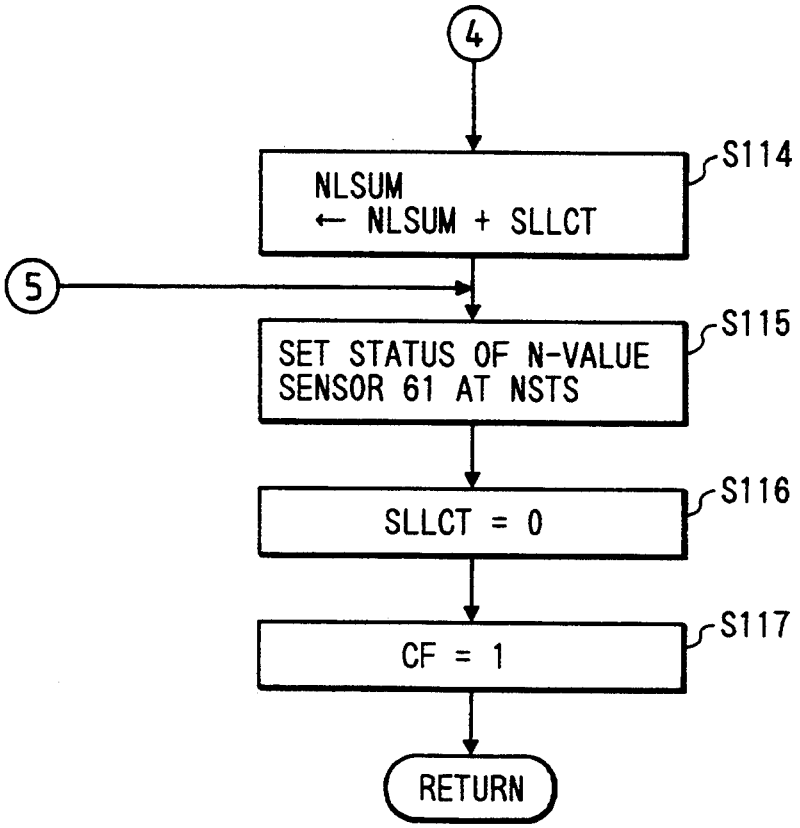

FIG. 13 is a flowchart showing the N-value control after recording for one line at step S25 in FIG. 8.

At step S101, a check is made to determine whether or not the mode is a normal mode, in which if it is the normal mode, the operation proceeds to step S102, where 4 is added to a two-byte counter (SLLCT) for counting the number of lines until the output value of the N-value sensor 61 is turned from on to off or from off to on. If the mode is a fine mode at step S103, 2 is added to the counter, while if the mode is a super fine mode, the counter is incremented by +1 at step S105. At step S106, a check is made to determine whether or not the value of the counter (SLLCT) is greater than the maximum number of lines (680 lines here) at which the disconnection of the ink sheet 14 is judged in the super fine mode, in which if it is greater, the operation proceed s to step S107, where the flag CF indicating the disconnection of the ink sheet 14 is set to be "0". Also, at step S106, the value of the counter SLLCT is less than "680", the operation proceeds to step S108, where the status of the N-value sensor 61 is input. And at step S109, a comparison is made between this status and a status stored in the NSTS. If the status of the N-value sensor 61 is not changed, the operation proceeds to step S110, where the flag CF is set to be "1", and then the operation returns to the original routine.

If the status is not coincident with the status stored in the NSTS at step S109, that is, if the status of slit signal has changed with the rotation of the N-value sensor 61, the operation proceeds to step S111, where a counter (NCNT) fox counting the number of measurements that the slit of the N-value sensor 61 is turned from on to off or from off to on is incremented by +1. Next, at step S112, a check is made to determine whether or not the value of previous counter (SLLCT) is within an effective range. This effective range can be determined depending on whether the value falls within a range from 24 to 187, inclusive, for example. If it is in the effective range, the operation proceeds to step S113, where a counter (NACNT) for counting the effective number of times that the slit signal of the N-value sensor 61 is turned from on to off or from off to on is incremented in virtue of the effective data.

At step S114, the value of previous counter (SLLCT) is added to a counter (NLSUM) for counting the number of lines in the effective measurement. Next, at step S115, a current status of the N-value sensor 61 is set to the NSTS, and at step S116, the value of counter (SLLCT) is cleared to "0". And at step S117, the flag CF is set to be "1", and the recording operation is continued.

Figure 15:
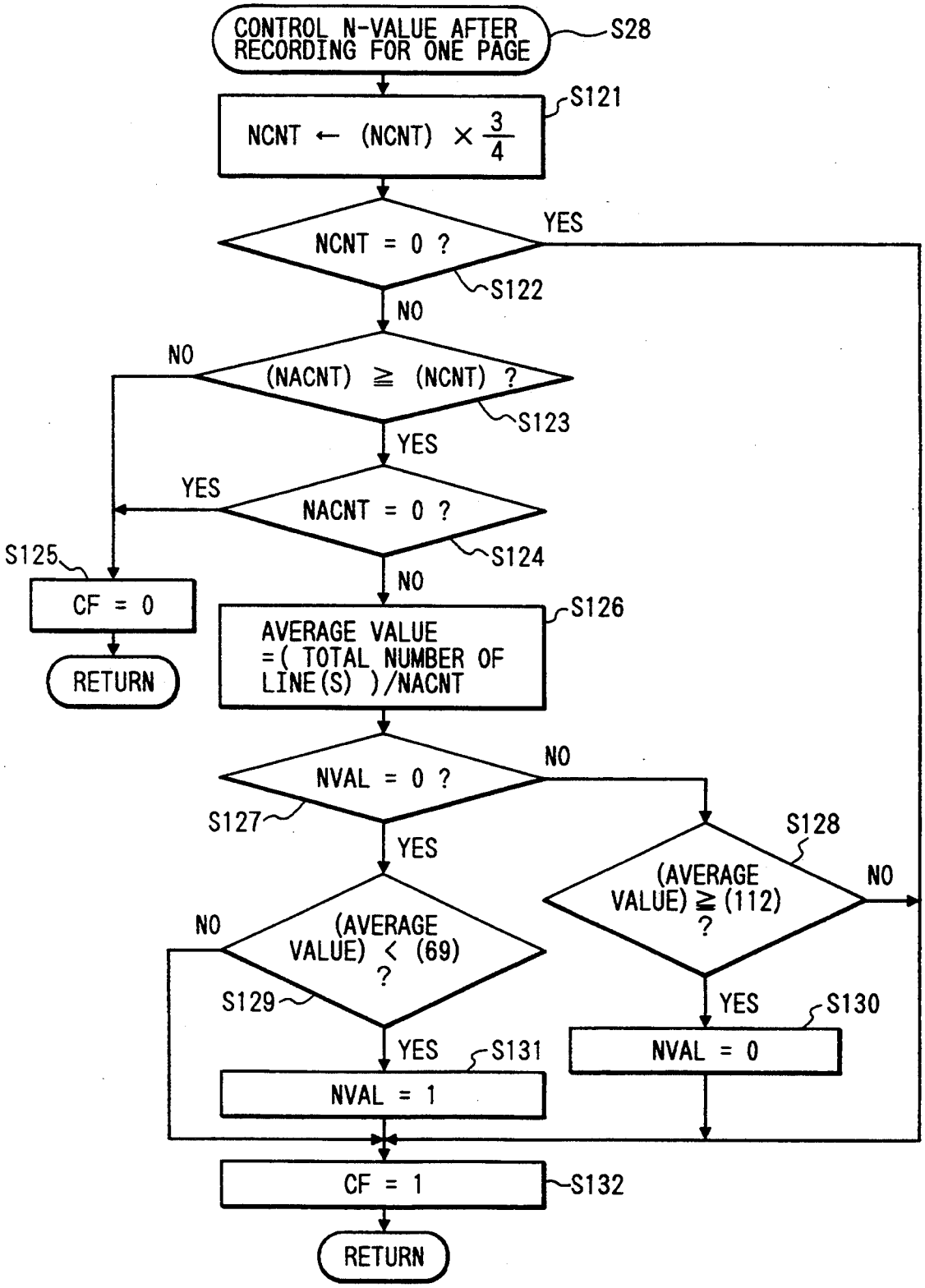
FIG. 15 is a flowchart showing the N-value control operation after recording one page in the facsimile terminal equipment in the example.

FIG. 15 is a flowchart showing the N-value control after recording for one page as shown at step S28 in FIG. 8. The N-value is changed as the take-up diameter of the ink sheet take-up roll 18 is varied during the recording for one page. Thus, by performing the N-value control after recording for one page, the effect can be obtained that the length of conveying the ink sheet can be held constant in recording the next page.

First, at step S121, the value of the counter (NCNT) storing the number of measurements that the slit signal of the N-value sensor 61 is turned from on to off or from off to on is multiplied by $\frac{3}{4}$. This is meant to consider up to 25% margin. This is because the N-value sensor 61 may have the vibration called as "chattering" so that take counter (NCNT) contains some error so as to be a slightly large value. At step S122, a check is made to determine whether or not the value of the counter NCNT is "0". If it is "0", the operation proceeds to step S132, where the flag CF is set to be "1". Then the operation returns to the original process.

If the value of the counter NCNT is not "0" at step S122, the operation proceeds to step S123, where a comparison is made between the value of the counter NCNT for counting the number of times that the slit signal of the N-value sensor 61 is turned from on to off or from off to on and the value of the counter NACNT for counting its effective number of times. If the value of NACNT is smaller, or zero at step S124, the operation proceeds to step S125, because of the abnormal condition, where the flag CF=0 is set, and the operation returns to the original process.

On the other hand, if the value of NACNT is not "0" but equal to or greater than the value of NCNT (normal condition), the operation proceeds to step S126, where the average number of lines when the slit signal of the N-value sensor 61 is turned from on to off or from off to on is obtained by dividing the value of NLSUM storing the total number of lines in the effective measurement at previous step S114 by the value of the counter NACNT.

At step S127, a check is made to determine whether or not the value of NVAL is "0", that is, the ink sheet 14 is conveyed by three half steps when recording for one line. If it is "0", the operation proceeds to step S129 to determine whether or not the average number of lines is smaller than a predetermined number (or 69 here). If it is smaller, the value of NVAL is set to be "1" at step S131, and the value of the flag CF is set to be "0" at step S132.

If the value of NVAL is not "0" at step S127, that is, in the mode in which the ink sheet 14 is conveyed by two half steps while the recording sheet 11 is conveyed by one half step, the operation proceeds to step S128 to determine whether or not the average number of lines is 112 or more. If it is 112 or more, the NVAL is set to be "0" at step S130. Thereby, if the number of lines to be recorded while the slit signal of the N-value sensor 61 changes is equal to or greater than a predetermined number, the amount of feeding the ink sheet is increased by switching the driving to three steps, while if the number of lines to be recorded is equal to or less than a predetermined number, the number of driving steps for the ink sheet conveying motor 25 is changed in accordance with the variation in the diameter of the ink sheet take-up roll 18, by switching the driving to two half steps. And the flag CF is set to be "1" at step S132, and the operation returns to the original process.

FIGS. 16 and 17 are flowcharts showing the N-value adjusting process at step S6 in FIG. 7.

At step S141, a determination is made whether or not the ink sheet cartridge is exchanged, and at step S142, a determination is made whether or not the operation is recordable, in which if the cartridge is not exchanged or the recording operation is not enabled, the operation returns to the original process. At step S143, a message of "Wait for a moment" is displayed on the indication unit 104, and at step S144, an exchange flag of the cartridge is turned off. At step S145, the slackness removal of ink sheet 14 is performed as at step S22 in FIG. 8. If an error may occur at step S145, the operation proceeds to step S147, where a message of "Check the ink sheet" is displayed.

If the slackness removal of ink sheet 14 is terminated, the operation proceeds to step S148, where the initialization is performed as at step S21 in FIG. 8. Next, at step S149, the counter CX is set to be "234", and at step S150, the standard mode is set. Next, proceeding to step S151, a check is made to determine whether or not the ink sheet conveying motor 25 is busy, in which if it is not busy, the ink sheet conveying motor 25 is rotated by eight half steps at 1200 pps at step S152 to convey the ink sheet. If the ink sheet conveying motor 25 is rotated by eight half steps in the standard mode as above described, the driving with eight half steps corresponds to the recording for one line in the standard mode, while the ink sheet conveying motor 25 is rotated by two half steps when recording for one line in the super fine mode.

Then, proceeding to step S153, the N-value control after recording for one line is performed as at step S25 in FIG. 8, and if an ink sheet error may occult, the operation proceeds to step S147. This process is repeated by the number of times which is set in the counter CX, i.e., "234". Thus, the conveyance process for the ink sheet 14 corresponding to 234 lines is performed, the operation proceeds to step S157, where the N-value control after recording for one page is carried out in order to set the value of NVAL, that is, to determine whether or not the ink sheet conveying motor 25 is driven by two half steps or three half steps when recording for one line in the super fine mode. If a conveyance error of the ink sheet 14 may not occur at step S158, the operation proceeds to step S159, where year, month and day at present are indicated on the indication unit 104. Then the operation is terminated. Next, the N-value control which is performed upon detecting the exchange of the ink sheet cartridge in the second example including the ink cartridge sensor 64 instead of the ink sheet sensor 20 will be described below.

Figure 18:
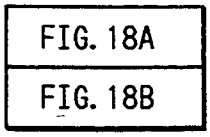
FIGS. 18 and 19 are flowcharts showing other operations in the facsimile terminal equipment in the example.
Figure 18A:
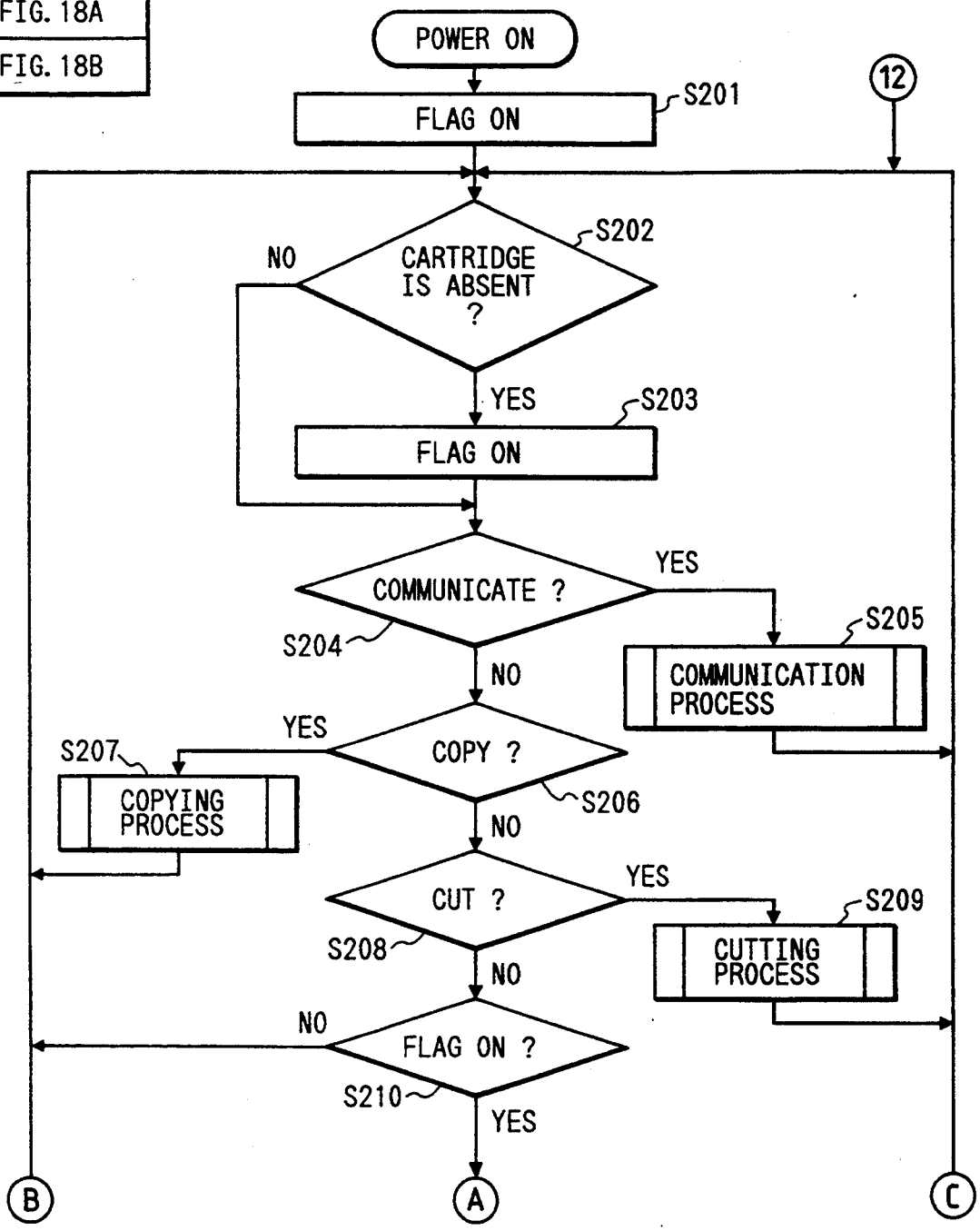
Figure 18B:
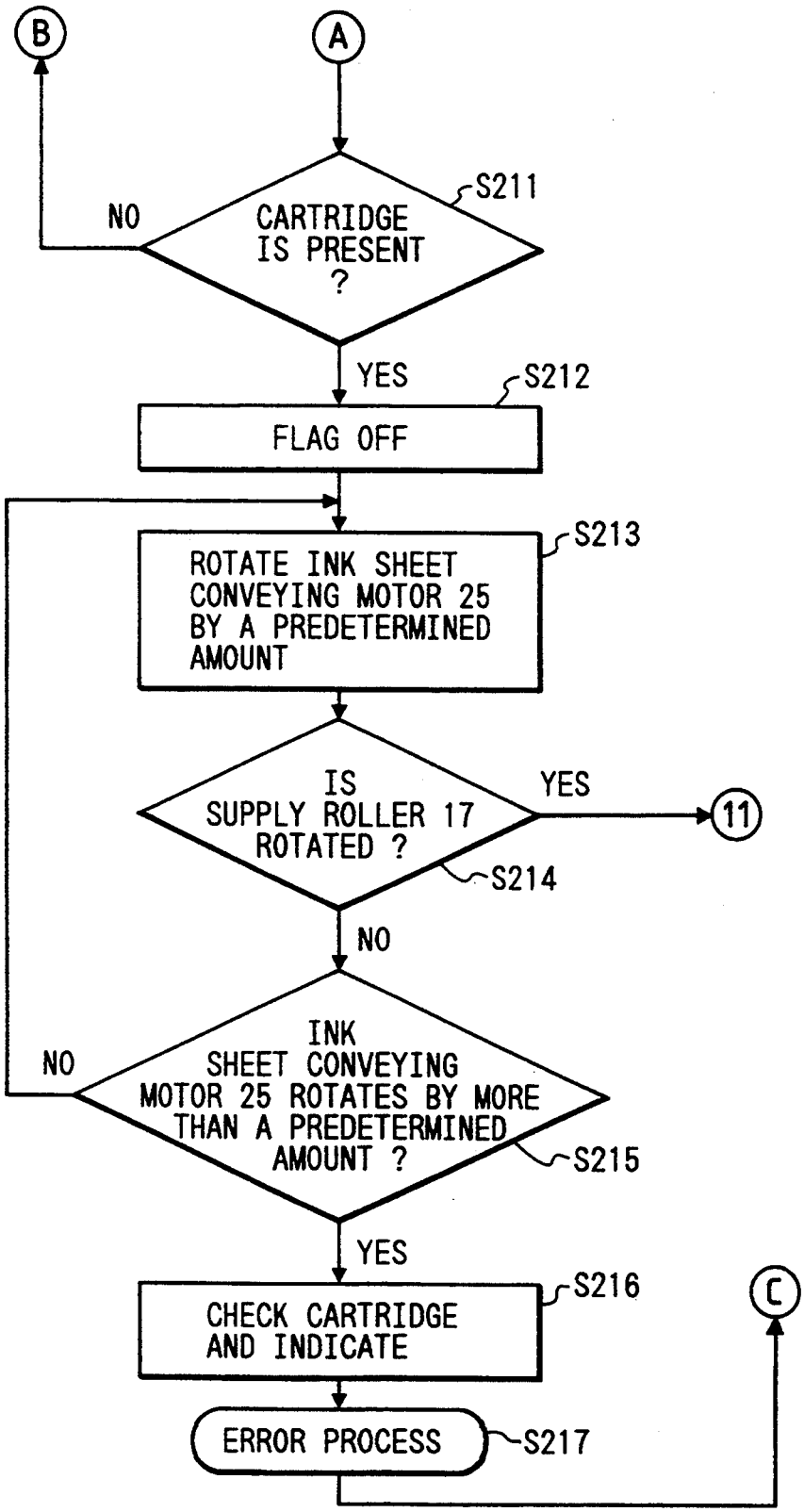
Figure 19:
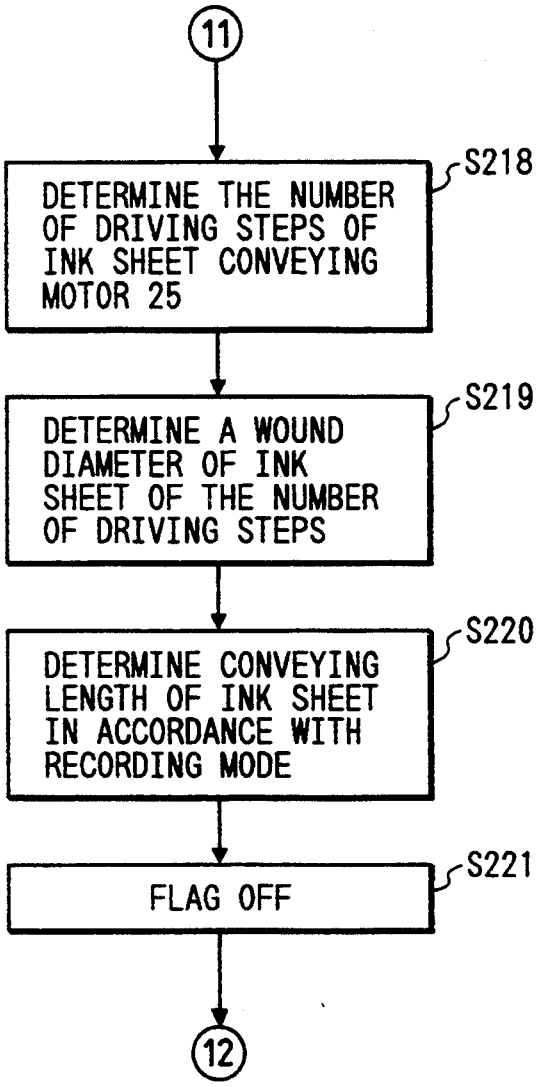

The operation of the facsimile terminal equipment in this example will be described with reference to flowcharts as shown in FIGS. 18 and 19. The control program for executing these flowcharts is stored in the ROM 114.

The process of FIGS. 18 and 19 is started upon turning on the power. At step S201, a flag of the RAM 115 is set to be "1". Next, proceeding to step S202, a determination is made whether or not the ink sheet cartridge is loaded, based on a signal from the ink sheet cartridge 64. The operation proceeds to step S204 if the ink sheet cartridge is loaded, or otherwise to step S203. At step S203, the flag is set to be on. And at step S204, a determination is made whether or not the transmission or reception process of a facsimile signal is performed, in which if the answer is yes, the operation proceeds to step S205, where a required transmission or reception process and a required recording operation are carried out. At step S206, a determination is made whether or not the copying operation is indicated, in which if it is indicated, the operation proceeds to step S207, where the copy operation is performed. If the cut operation of the recording sheet 11 is indicated at step S208, the operation proceeds to step S209, where the recording sheet 11 is cut off in a unit of page by driving a cutter 15. If neither of these functions is indicated, the operation proceeds to step S210 to determine whether or not the flag is on. If the flag is off, the operation returns to step S202, and the switch entry operation for the reception of the facsimile signal or the copy indication from the operation unit 103 is performed.

If the flag is on at step S210, the operation proceeds to step S213, where the ink sheet conveying motor 25 is rotated by one step, for example. Next, proceeding to step S214, a check is made to determine whether or not the ink sheet supply roller 17 is rotated, that is, the photo interruptor 62 has detected the passage of the slit 63, based on a signal from the photo interruptor 62. If the ink sheet supply roller 17 is not rotated at step S214, the operation proceeds to step S215, where a check is made to determine whether or not the ink sheet conveying motor 25 is rotated by a predetermined amount. In this way, a check for the disconnection of the ink sheet 14 and the slackness removal of ink sheet are performed. Thus, if the ink sheet supply roller 17 is not rotated regardless of a predetermined amount of rotation for the ink sheet conveying motor 25, a message of checking the cartridge is indicated at step S216, because there is a possibility that the ink sheet may be disconnected, for example. Then at step S217, the operation transfers to an error process to wait for the exchange of the cartridge. If the cartridge is exchanged in the error process at step S217, the operation returns to step S202.

In this way, if the rotation of the ink sheet supply roller 17 is not detected in the course from step S213 to step S217, notwithstanding that the cartridge is detected to be present at step S211, an error is judged to indicate a false condition in which the cartridge is present but the ink sheet is disconnected or used up, whereby it is possible to check to see whether or not the ink sheet is currently available.

If the cartridge is exchanged in this way, the operation proceeds from step S202 to step S203, where the flag of the RAM 115 i s set to be on.

On the other hand, if the ink sheet supply roller 17 is detected for a predetermined amount of rotation in accordance with the rotation of the ink sheet conveying motor 25, it is considered that the slackness of ink sheet 14 is removed, and thus the operation proceeds to step S218, where the number of driving steps for the ink sheet conveying motor 25 to be driven while the slit 63 of the N-value sensor 61 is turned from on to off or from off to on is obtained. And at step S219, the take-up diameter of the ink sheet take-up roll 18 is obtained based on the number of driving steps. The calculation of the take-up diameter was detailed in the explanation of the expressions (9) to (12) as previously described, and will be omitted here. Then, at step S220, the number of driving steps for the ink sheet conveying motor 25 for one line of the recording sheet 11 is determined in accordance with the recording mode such as the super fine mode or fine mode, based on the take-up diameter which was obtained at step S219. In practice, this allows the conveying speed of the ink sheet 14 to be changed in accordance with the recording mode, as the conveying speed of the recording sheet 11 is constant. For example, the conveying speed of the recording sheet 11 is 400 pps in the super fine mode, and the conveying speed of the ink sheet 14 is 800 pps or 1200 pps.

Next, proceeding to step S221, the flag is turned off to reset the exchange mode of the ink sheet cartridge. And tile operation returns to step S202 to repeat: the processing as above described.

The ratio n of the conveying speed of the recording sheet 11 to that of the ink sheet 14 can be arbitrarily set by arbitrarily designing the relation between a gear transmission reduction ratio of the ink sheet driving transmission gears 66, 67, and a gear transmission reduction ratio of the platen driving transmission gears 26, 27. Also, the value n can be arbitrarily changed by changing the frequency ratio of phase excitation signal for the ink sheet motor driver 49 to that for the recording sheet motor driver 48. Further, tile value n can be arbitrarily changed by selecting arbitrarily the step feed angle for each phase excitation signal for tile ink sheet conveying motor 25 and the recording sheet conveying motor 24. Thereby, the recording sheet 11 is conveyed by one line in the direction of arrow b in FIG. 2, when recording for one line, while the ink sheet 14 is conveyed by 1/n line in the direction of arrow a.

As above described, according to this example, in the thermal transfer recording in which the length of the ink sheet 14 to be used in recording is L/n (n>1) for a predetermined recording length L, the conveyance length of the ink sheet relative to the conveyance length of the recording sheet can be always constant in recording, by determining the take-up diameter of the ink sheet when the ink sheet cartridge is exchanged, or when the power is turned on, and accordingly, switching the number of driving steps for the ink sheet conveying motor.

[Explanation of Recording Principal (FIG. 20)]

Figure 20:
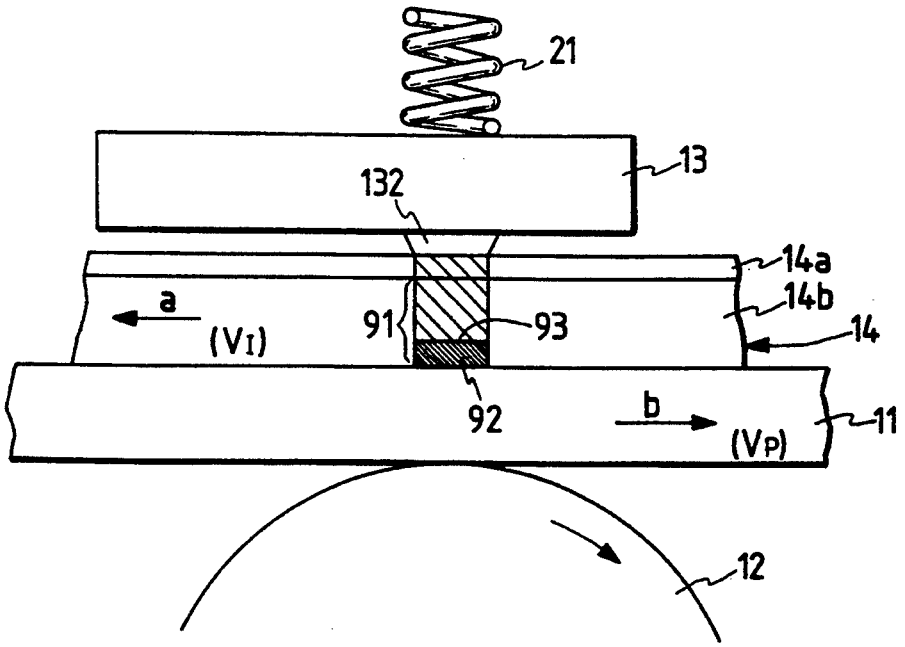
FIG. 20 is a view showing the principle of the multi-print in recording in the example.

FIG. 20 is a view showing the image recording state in this example, with the directions for conveying the recording sheet 11 and the ink sheet 14 being opposite.

As shown in the figure, the recording sheet 11 and the ink sheet 14 are carried between the platen roller 12 and the thermal head 13, with the thermal head 13 being pressed against the platen roller 12 at a predetermined pressure by means of a spring 21. Here the recording sheet 11 is conveyed in the arrow b direction at the speed $V_p$ with the rotation of the platen roller 12. On the other hand, the ink sheet 14 is conveyed in the arrow a direction at the speed $V_I$ with the rotation of the ink sheet conveying motor 25.

Now, if the heating resistors 132 of the thermal head 13 are energized and heated by the power source 105, a slanting line portion 81 of the ink sheet 14 is heated. 14*a* is a base film of the ink sheet 14, and 14*b* is an ink layer of the ink sheet 14. The ink in the ink layer 81 heated by energizing the heating resistors 132 becomes fused, with a part thereof as indicated at 82 being transferred to the recording sheet 11. The ink layer portion 82 to the transferred corresponds to almost 1/n (n>1) of the ink layer as indicated at 81.

At such an ink transfer operation, it is necessary to transfer only the portion as indicated at 82 to the recording sheet 11 by yielding a shear force within the ink at a boundary line 83 with the ink layer 14*b*. However, this shear force depends on the temperature of the ink layer, and tends to be smaller with increasing temperature of the ink layer. And the ink layer to be transferred can be surely peeled off from the ink sheet 14 by increasing a relative speed between the ink sheet 14 and the recording sheet 11, as the shear force within the ink layer becomes larger with a shorter heating time of the ink sheet.

With this example, the relative speed between the ink sheet 14 and the recording sheet 11 may be increased by conveying the ink sheet 14 and the recording sheet 11 in opposite directions, as the heating time of the thermal head 13 in the facsimile terminal equipment is short such as about 0.6 ms.

[Explanation of Ink Sheet (FIG. 21)]

Figure 21:
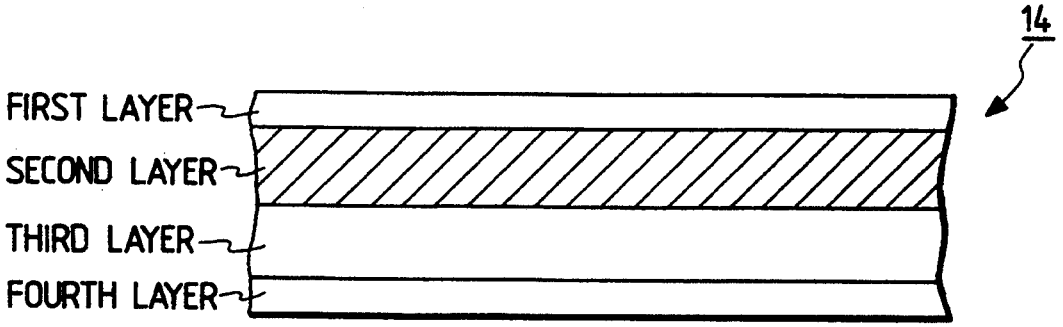
FIG. 21 is a cross-sectional view of a multi ink sheet useful in the example.

FIG. 21 shows a cross-sectional view of an ink sheet for use in the multi print in this example, consisting of four layers.

The second layer is a base film serving as a carrier for the ink sheet 14. In the multi print, as the heat energy is applied to the same place as may times, it is advantageous to use a high heat resistant aromatic polyamide film or condenser paper, but a conventional polyester film can be used as well. The thickness should be thinner from the viewpoint of the print quality, as the role of medium, but it is preferably in a range of 3–8 μm from the standpoint of strength.

The third layer is an ink layer containing a sufficient amount of ink to allow n times of transfers onto the recording sheet. This component has blended as the main components a resin such as EVA for adhesive, a carbon black or nigrosine dye for coloring, and a carnauba wax or paraffin wax for binding material, so as to withstand n multiple uses at the same location. The amount of application is preferably 4–8 g/m$^2$, but may be selected as desired, as the sensitiveness and density depend on the amount of application.

The fourth layer is a portion not to be used for the recording, i.e., a top coating layer for preventing the ink on the third layer from transferring with the pressure onto the recording sheet, made up of a transparent wax. Thereby, it is only the transparent fourth layer that is transferred with the pressure, so that it is possible to prevent the surface of recording sheet from being dirty. The first layer is a heat resistant coated layer for protecting the base film of the second layer from the heating of the thermal head 13. This is suitable for the multi print which has a possibility that the amount of heat energy corresponding to as many as n lines may be applied to the same place (for successive black data), but may or may not be used as appropriate. It is effective for the base film having a relatively low heat resistance such as a polyester film.

It should be noted that the constitution of the ink sheet 14 is not limited to one of the above example, but may be composed of a base layer and a porous ink holding layer containing the ink provided on one side of the base layer, or a heat resistive ink layer having a fine porous mesh structure on the base film and containing the ink within the ink layer. The material of the base film may be a film or paper composed of polyamide, polyethylene, polyester, polyvinylchloride, triacetylcellulose, nylon. Further, the heat resistive coating layer, which is not necessarily required, is made of the material such as silicon resin, epoxy resin, fluororesin, or nitrocellulose.

An example of the ink sheet having the heat sublimable ink is one in which a color material layer containing spacer grains or dye formed of guanamine resin or fluororesin is provided on a substrate formed of polyethylene terephthalate, polyethylene naphthalate or aromatic polyamide film.

The heating method in the thermal transfer printer is not limited to a thermal head method using the thermal head as previously described, but may be a current or laser transfer method.

The recording medium is not limited to recording sheet, but may be a cloth or plastic sheet if the material is one onto which the ink can be transferred. Also, the ink sheet is not limited to a roll constitution as shown in the example, but may be an so-called ink sheet cassette type in which an ink sheet is contained within an enclosure which is detachably loaded into a main body of the recording apparatus.

Further, while for the recording with the thermal head 13, the amount of taking up the ink sheet 14 is determined corresponding to a predetermined amount of conveying the recording medium in the recording operation of the: next page, upon detecting the ink sheet 14 from absent state to present state, this operation may be made upon detecting the ink sheet cartridge from absent state to present state. Also, while the ink sheet conveying motor 25 is rotated by two half steps or three half steps when recording for one line in the super fine mode, the number of driving steps for the ink sheet conveying motor 25 can be switched at more stages.

This example was described in connection with an instance of using the thermal line head, but is not limited to such an instance, and may be made with a so-called serial-type thermal transfer printer. Also, this example was described in connection with an instance of the multi print, but is not limited to such an instance, and may be of course applicable to an ordinary thermal transfer recording with the one-time ink sheet.

Further, the example was described in connection with an instance where the thermal transfer printer was applied to the facsimile terminal equipment, but is not limited to such as instance, and the thermal transfer recording apparatus of the present invention can be applied to a word processor, typewriter or copying apparatus, for example.

With this example, it is possible to control the amount of conveying the ink sheet 14 relative to a predetermined amount of conveying the recording sheet 11 to be substantially constant, in such a way as to take up the ink sheet with the rotation of a rotation shaft for the ink sheet take-up roll 18, and control the rotation amount corresponding to an increasing diameter of the ink sheet take-up roll 18, as above described. It is thereby unnecessary to provide a capstan roller or pinch roller which controls the conveyance of the ink sheet 14, so that there is the effect that the constitution of a mechanical portion for the printer is simpler.

Also, with this example, it is possible to maintain the amount of conveying the ink sheet relative to a predetermined amount of conveying the recording sheet substantially constant, even if the ink sheet may be exchanged halfway of the recording.

What is claimed is:

1. A recording apparatus for recording an image by transferring an ink contained in an ink sheet onto a recording medium, the apparatus comprising:

ink sheet conveying means for conveying said ink sheet;

recording medium conveying means for conveying said recording medium, said ink sheet conveying means conveying per unit time an amount of said ink sheet which is less than an amount of said recording medium conveyed per unit time by said recording medium conveying mean;

recording means for recording onto said recording medium by acting on said ink sheet;

slackness removing means for removing a slackness of said ink sheet; and control means for controlling a driving amount of said ink sheet conveying means after the slackness of said ink sheet is removed with said slackness removing means, said control means controlling, after the slackness of the ink sheet is removed, the driving amount of the ink sheet conveying means prior to recording so as to maintain a substantially constant ratio of said amount of said ink sheet conveyed per unit time and said amount of said recording medium conveyed per unit time.

2. An image forming apparatus for recording an image by transferring an ink contained in an ink sheet onto a recording medium, the apparatus comprising:

ink sheet conveying means for conveying said ink sheet;

recording medium conveying means for conveying said recording medium, said ink sheet conveying means conveying per unit time an amount of said ink sheet which is less than an amount of said recording medium conveyed per unit time by said recording medium conveying means;

at least one of image signal receiving means and image signal transmitting means;

recording means for recording onto said recording medium by acting on said ink sheet;

slackness removing means for removing a slackness of said ink sheet; and control means for controlling a driving amount of said ink sheet conveying means after the slackness of said ink sheet is removed with said slackness removing means, said control means controlling, after the slackness of the ink sheet is removed, the driving amount of the ink sheet conveying means prior to recording so as to maintain a substantially constant ratio of said amount of said ink sheet conveyed per unit time and said amount of said recording medium conveyed per unit time.

3. An image forming apparatus according to claim 2, further comprising reading means for reading an original image.

4. A recording apparatus for recording an image by transferring an ink contained in an ink sheet onto a recording medium, the apparatus comprising:

ink sheet conveying means for conveying said ink sheet being extended between a supply roller and a take-up roller with a rotation of said take-up roller;

rotation amount detecting means for detecting rotation amount of said supply roller;

recording medium conveying means for conveying said recording medium, said ink sheet conveying means conveying per unit time an amount of said ink sheet which is less than an amount of said recording medium conveyed per unit time by said recording medium conveying means;

recording means for recording onto said recording medium by acting on said ink sheet;

slackness removing means for removing a slackness of said ink sheet; and control means for controlling a rotation amount of said take-up roller with said ink sheet conveying means in accordance with the rotation amount of said supply roller detected by said rotation amount detecting means, in such a way as to rotate a rotation shaft of said take-up roller by a predetermined amount by driving said ink sheet conveying means after the slackness of said ink sheet is removed with said slackness removing means, said control means controlling, after the slackness of the ink sheet is removed, a driving amount of the ink sheet conveying means prior to recording so as to maintain a substantially constant ratio of said amount of said ink sheet conveyed per unit time and said amount of said recording medium conveyed per unit time.

5. The recording apparatus according to claim 4, wherein said control means controls the rotation amount of said take-up roller with said ink sheet conveying means to be less when the rotation amount of said supply roller per unit time to be detected by said rotation amount detecting means is equal to or greater than a predetermined amount than when said rotation amount is less than said predetermined amount.

6. An image forming apparatus for recording an image by transferring an ink contained in an ink sheet onto a recording medium, the apparatus comprising:

ink sheet conveying means for conveying said ink sheet;

recording medium conveying means for conveying said recording medium, said ink sheet conveying means for conveying per unit time an amount of said ink sheet which is less than an amount of said recording medium conveyed per unit time by said recording medium conveying means;

means for reading an original image;

recording means for recording onto said recording medium by acting on said ink sheet;

slackness removing means for removing a slackness of said ink sheet; and control means for controlling a driving amount of said ink sheet conveying means after the slackness of said ink sheet is removed with said slackness removing means, said control means controlling, after the slackness of the ink sheet is removed, the driving amount of the ink sheet conveying means prior recording so as to maintain a substantially constant ratio of said amount of said ink sheet convened per unit time and said amount of said recording medium conveyed per unit time.

7. A method of recording an image by transferring an ink contained in an ink sheet onto a recording medium, the method comprising the steps of:

conveying said ink sheet using an ink sheet conveying means;

conveying said recording medium, so that said ink sheet is conveyed per unit time an amount which is less than an amount of said recording medium conveyed per unit time;

recording onto said recording medium by acting on said ink sheet;

removing a slackness of said ink sheet; and controlling a driving amount of said ink sheet conveying means after the slackness of said ink sheet is removed, so that prior to recording, a substantially constant ratio is maintained of said amount of said ink sheet conveyed per unit time and said amount of said recording medium conveyed per unit time.

8. A method of recording an image by transferring an ink contained in an ink sheet onto a recording medium, the method comprising the steps of:

conveying said ink sheet using an ink sheet conveying means;

conveying said recording medium, so that said ink sheet is conveyed per unit time an amount which is less than an amount of said recording medium conveyed per unit time;

providing at least one of image signal receiving means and image signal transmitting means;

recording onto said recording medium by acting on said ink sheet;

removing a slackness of said ink sheet; and controlling a driving amount of said ink sheet conveying means after the slackness of said ink sheet is removed in said removing step, so that prior to recording, a substantially constant ratio is maintained of said amount of said ink sheet conveyed per unit time and said amount of said recording medium conveyed per unit time.

9. A method of recording an image by transferring an ink contained in an ink sheet onto a recording medium, the method comprising the steps of:

conveying said ink sheet using an ink sheet conveying means, said ink sheet being extended between a supply roller and a take-up roller, with a rotation of said take-up roller;

detecting a rotation amount of said supply roller;

conveying said recording medium, so that said ink sheet is conveyed per unit time an amount which is less than an amount of said recording medium conveyed per unit time;

recording onto said recording medium by acting on said ink sheet;

removing a slackness of said ink sheet; and controlling a rotation amount of said take-up roller with said ink sheet conveying means in accordance with the rotation amount of said supply roller detected in said detecting step, in such a way as to rotate a rotation shaft of said take-up roller by a predetermined amount by driving said ink sheet conveying means after the slackness of said ink sheet is removed in said removing step, so that prior to recording, a substantially constant ratio is maintained of said amount of said ink sheet conveyed per unit time and said amount of said recording medium conveyed per unit time.

10. A method of recording an image by transferring an ink contained in an ink sheet onto a recording medium, comprising the steps of:

conveying said ink sheet using an ink sheet conveying means;

conveying said recording medium, so that said ink sheet is conveyed per unit time an amount which is less than an amount of said recording medium conveyed per unit time;

reading an original image;

recording onto said recording medium by acting on said ink sheet;

removing a slackness of said ink sheet; and controlling a driving amount of said ink sheet conveying means after the slackness of said ink sheet is removed in said removing step, so that prior to recording, a substantially constant ratio is maintained of said amount of said ink sheet conveyed per unit time and said amount of said recording medium conveyed per unit time.

* * * * *

UNITED STATES PATENT AND TRADEMARK OFFICE

CERTIFICATE OF CORRECTION

PATENT NO. : 5,379,055

DATED : January 3, 1995

INVENTOR(S) : TAKEHIRO YOSHIDA, ET AL.

It is certified that error appears in the above-identified patent and that said Letters Patent is hereby corrected as shown below:

COLUMN 1

Line 8, "invent ion" should read --invention--.
Line 39, "No. 3984809," should read --No. 3,984,809,--.

COLUMN 2

Line 68, "On." should read --on.--.

COLUMN 4

Line 39, "<Explanation" should read --¶ <Explanation--.

COLUMN 7

Line 37, "sheet: 11" should read --sheet 11--.
Line 39, Close up right margin.
Line 40, Close up left margin.

COLUMN 8

Line 64, "would" should read --wound--.

COLUMN 9

Line 51, "tile" should read --the--.
Line 66, "be" should be deleted.

UNITED STATES PATENT AND TRADEMARK OFFICE

CERTIFICATE OF CORRECTION

PATENT NO. : 5,379,055

DATED : January 3, 1995

INVENTOR(S) : TAKEHIRO YOSHIDA, ET AL.

It is certified that error appears in the above-identified patent and that said Letters Patent is hereby corrected as shown below:

COLUMN 10

Line 18, "belong." should read --below.--.
Line 29, "a" (second occurrence) should be deleted.
Line 38, "{(1/15.4N)/(D/2)" should read --{(1/15.4N)/(D/2)}--.

COLUMN 11

Line 21, "owing ($\pi r_1^2 - \pi r_0^2$ = tL" should read --owing to ($\pi r_1^2 - \pi r_0^2$ = tL--.
Line 22, "find" should read --and--.
Line 67, "motor?" should read --motor 25)--.
Line 68, "5)" should be deleted.

COLUMN 12

Line 41, "slider" should read --super--.
Line 61, "Steps" should read --steps--.

COLUMN 14

Line 19, "value.," should read --value--.
Line 21, "for lows." should read --follows.--.
Line 27, "(lines)" (second occurrence) should be deleted.
Line 62, "339.5xSQRT{605-(22/2)$^2$56 /22 = 339.5" should read --339.5xSQRT{605-(22/2)$^2$}/22 = 339.5--.
Line 66, "6 times,." should read --6 times.--.

UNITED STATES PATENT AND TRADEMARK OFFICE

CERTIFICATE OF CORRECTION

PATENT NO. : 5,379,055

DATED : January 3, 1995

INVENTOR(S) : TAKEHIRO YOSHIDA, ET AL.

It is certified that error appears in the above-identified patent and that said Letters Patent is hereby corrected as shown below:

COLUMN 15

Line 10, "unit 114." should read --unit 101.--.
Line 16, "detail" should read --detailed--.
Line 22, "carriage" should read --cartridge--.

COLUMN 16

Line 18, "or" should be deleted.
Line 55, "or" should be deleted.

COLUMN 17

Line 22, "followings," should read --following,--.
Line 27, "s ted S11," should read --step S11,--.

COLUMN 18

Line 14, "signal )" should read --signal)-- and "Slit" should read --slit--.
Line 67, "did" should read --dip--.

COLUMN 19

Line 18, "S71," should read --step S71,--.
Line 51, "i s" should read --is--.

COLUMN 20

Line 2, "proceed s" should read --proceeds--.
Line 4, "the" should read --if the--.
Line 52, "take" should read --the--.

UNITED STATES PATENT AND TRADEMARK OFFICE

CERTIFICATE OF CORRECTION

PATENT NO. : 5,379,055

DATED : January 3, 1995

INVENTOR(S) : TAKEHIRO YOSHIDA, ET AL.

It is certified that error appears in the above-identified patent and that said Letters Patent is hereby corrected as shown below:

COLUMN 22

Line 3, "occult," should read --occur,--.

COLUMN 23

Line 17, "i s" should read --is--.
Line 45, "tile" should read --the-- and "repeat:" should read --repeat--.
Line 56, "tile" should read --the--.
Line 58, "tile" should read --the--.

COLUMN 24

Line 24, "81" should read --91--.
Line 26, "81" should read --91--.
Line 28, "82" should read --92--.
Line 29, "82" should read --92-- and "the" should read --be--.
Line 31, "81" should read --91--.
Line 33, "82" should read --92--.
Line 34, "yielding" should read --yielding to--.
Line 35, "83" should read --93--.
Line 57, "as may" should read --many--.

COLUMN 25

Line 49, "an" should read --a--.
Line 57, "the:" should read --the--.

UNITED STATES PATENT AND TRADEMARK OFFICE

CERTIFICATE OF CORRECTION

PATENT NO. : 5,379,055

DATED : January 3, 1995

INVENTOR(S) : TAKEHIRO YOSHIDA, ET AL.

It is certified that error appears in the above-identified patent and that said Letters Patent is hereby corrected as shown below:

COLUMN 26

Line 8, "as" should read --an--.

COLUMN 27

Line 26, "rota-" should read --a rota- --.

COLUMN 28

Line 17, "prior" should read --prior to--.

Signed and Sealed this

Fifteenth Day of August, 1995

Bruce Lehman

*Attest:*

BRUCE LEHMAN

*Attesting Officer*

*Commissioner of Patents and Trademarks*